US012428828B2

(12) United States Patent
Garrels et al.

(10) Patent No.: US 12,428,828 B2
(45) Date of Patent: Sep. 30, 2025

(54) GREY WATER TOILET AND FLUSHING METHOD

(71) Applicant: Kohler Co., Kohler, WI (US)

(72) Inventors: Clayton C. Garrels, Sheboygan, WI (US); William C. Kuru, Plymouth, WI (US); Randy S. Graskamp, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 18/390,662

(22) Filed: Dec. 20, 2023

(65) Prior Publication Data

US 2024/0125103 A1 Apr. 18, 2024

Related U.S. Application Data

(60) Continuation of application No. 17/497,300, filed on Oct. 8, 2021, now Pat. No. 11,885,111, which is a continuation of application No. 16/829,913, filed on Mar. 25, 2020, now Pat. No. 11,168,471, which is a division of application No. 14/019,487, filed on Sep. 5, 2013, now Pat. No. 10,655,313.

(60) Provisional application No. 61/697,565, filed on Sep. 6, 2012.

(51) Int. Cl.

| | |
|---|---|
| ***E03D 5/00*** | (2006.01) |
| ***E03D 1/08*** | (2006.01) |
| ***E03D 1/34*** | (2006.01) |

(52) U.S. Cl.

CPC ..... *E03D 5/006* (2013.01); *E03D 1/08* (2013.01); *E03D 1/34* (2013.01); *E03D 5/003* (2013.01)

(58) Field of Classification Search

CPC ..... E03D 5/006
USPC ..... 4/366, 363, 377
See application file for complete search history.

(56) References Cited

U.S. PATENT DOCUMENTS 986,486 A * 3/1911 Miller et al. ..... E03D 9/12 4/430
3,224,013 A 12/1965 Tubbs
4,077,602 A 3/1978 Klessig
(Continued)

FOREIGN PATENT DOCUMENTS

CN 2656513 Y 11/2004
CN 201443130 U 4/2010
(Continued)

OTHER PUBLICATIONS

English translation of Patent No. NL1023302C2.
(Continued)

*Primary Examiner* — Christine J Skubinna
(74) *Attorney, Agent, or Firm* — Lempia Summerfield Katz LLC

(57) ABSTRACT

A method of flushing a toilet that includes opening a first valve to introduce a first supply of grey water into a passage to prime a siphon; opening a second valve to introduce a second supply of water into a bowl from a tank, the bowl having an outlet that is in fluid communication with an inlet of the passage; closing the first valve to shut off the first supply of water; evacuating the contents of the bowl through an outlet of the passage by way of the siphon generated by the introduction of the first supply of water and the introduction of the second supply of water; and closing the second valve to shut off the second supply of water.

19 Claims, 17 Drawing Sheets

(56) References Cited

U.S. PATENT DOCUMENTS

| | | | | |
|---|---|---|---|---|
| 4,086,668 | A * | 5/1978 | Tubbs | E03D 11/02 137/846 |
| 5,142,712 | A | 9/1992 | Hennessy | |
| 5,204,999 | A | 4/1993 | Makita et al. | |
| 5,579,542 | A | 12/1996 | Hayman | |
| 5,642,533 | A | 7/1997 | Young | |
| 5,845,346 | A * | 12/1998 | Johnson, Jr. | E03B 1/04 4/665 |
| 5,887,292 | A | 3/1999 | Goren | |
| 7,325,258 | B2 | 2/2008 | Asada et al. | |
| 8,082,605 | B2 | 12/2011 | Andreiu | |
| 8,418,277 | B2 | 4/2013 | Okubo | |
| 8,607,377 | B2 * | 12/2013 | Borg | E03B 1/041 4/665 |
| 2005/0102747 | A1 | 5/2005 | Stewart | |
| 2009/0151063 | A1 | 6/2009 | Shirai et al. | |
| 2010/0017949 | A1 | 1/2010 | Nishizaki et al. | |
| 2012/0000014 | A1 * | 1/2012 | Hall | E03C 1/122 4/430 |

FOREIGN PATENT DOCUMENTS

| | | | | |
|---|---|---|---|---|
| DE | 3536691 | A1 | 4/1987 | |
| DE | 19600284 | A1 | 7/1997 | |
| NL | 1023302 | C2 * | 11/2004 | E03D 11/08 |

OTHER PUBLICATIONS

European Office Action from European Patent Application No. 21160123.2, dated Nov. 11, 2022, 4 pages.

European Search Report for European Patent Application No. 21160123.2-1002 dated Jul. 1, 2021.

International Search Report and Written Opinion dated Jan. 7, 2014 for PCT App No. PCT/US2013/058340.

* cited by examiner

GREY WATER TOILET AND FLUSHING METHOD

CROSS REFERENCE TO RELATED APPLICATIONS

This application is a Continuation under 35 U.S.C § 120 and 37 C.F.R. § 1.53(b) of U.S. patent application Ser. No. 17/497,300 filed Oct. 8, 2021, which is a Continuation under 35 U.S.C § 120 and 37 C.F.R. § 1.53 (b) of U.S. patent Application Ser. No. 16/829,913 filed Mar. 25, 2020, which is a Divisional of U.S. patent Application Ser. No. 14/019,487, filed on Sep. 5, 2013, which claims the benefit of and priority to U.S. Provisional Patent Application No. 61/697,565, which was filed on Sep. 6, 2012. The foregoing U.S. applications are incorporated by reference herein in their entireties.

BACKGROUND

This application relates generally to the field of toilets. More specifically, this application relates to toilets configured to utilize grey water during operation to reduce the consumption or use of fresh or clean water during operation.

Conventional toilets are configured to utilize fresh (e.g., potable, clean, purified) water that is delivered to the bowl of the toilet to help evacuate waste contents from the bowl. In the U.S., the type of water and amount of water delivered to the bowl is generally regulated by code or regulation. For example, the maximum volume (e.g., 6.1 L or 1.6 gallons) of fresh water per flush cycle has been regulated for some time in the U.S. and there is an ever increasing pressure for water conservation (i.e., to consume less fresh water). Accordingly, it would be advantageous to provide a toilet that is configured to utilize a reduced volume of fresh water, such as, for example, by introducing a second alternative volume of water (e.g., grey water) into the flush cycle without adversely affecting the performance of the toilet.

SUMMARY

At least one embodiment of this application relates to a toilet configured to be in fluid communication with a drain pipe. The toilet includes a tank, a bowl, and a passage. The tank is configured to hold a first supply of water therein. The bowl has an inlet and an outlet, wherein the inlet is in fluid communication with the tank, such that the bowl is configured to receive the first supply of water. The passage has a first end, a second end, and an inlet opening provided between the first end and the second end. The first end is in fluid communication with the outlet of the bowl, and the second end is configured to be in fluid communication with the drain pipe. The passage is configured to receive a second supply of water through the inlet opening during a flush cycle.

The passage may include a weir that is provided between the first and second ends. wherein the inlet opening is provided between the weir and the second end. A portion of the passage that is provided between the weir and the second end may be configured to define a waste side of the passage, wherein the second supply of water may be grey water and may remain on the waste side of the passage during the flush cycle, and wherein the first supply of water may be fresh water.

The toilet may optionally include a grey water system that includes a storage device that is configured to hold a volume of the grey water, where the storage device has an outlet that is in fluid communication with the inlet opening of the passage. The grey water system may optionally include a valve disposed between the inlet opening of the passage and the outlet of the storage device, where the valve is configured to control the flow of the grey water from the storage device to the passage. The grey water system may optionally include a collection device that is configured to collect the grey water. The grey water system may optionally include a pump provided between the collection device and the storage device, where the pump is configured to move the collected grey water from the collection device to the storage device. The collection device may, for example, be a drain for one of a shower and a bath. Alternatively, the collection device may be configured to capture rainwater.

According to one example, the storage device is located in the tank of the toilet. For example, the tank may be configured to include a compartment for storing the fresh water therein, where the grey water in the storage device is fluidly separated from the fresh water in the compartment of the tank. According to another example, the storage device is located in a base of the toilet that houses the bowl.

At least one embodiment of this application relates to a method of flushing a toilet, such as a grey water toilet. The method of flushing the toilet includes opening a first valve to introduce a first supply of grey water into a passage to prime a siphon; opening a second valve to introduce a second supply of water into a bowl from a tank, the howl having an outlet that is in fluid communication with an inlet of the passage; closing the first valve to shut off the first supply of water; evacuating the contents of the bowl through an outlet of the passage by way of the siphon generated by the introduction of the first supply of water and the introduction of the second supply of water; and closing the second valve to shut off the second supply of water.

The method may further include an actuator, the actuator being configured to open the first valve and the second valve. The first supply of water may be grey water or fresh water, and the second supply of water may be fresh water.

At least one embodiment of this application relates to a method of flushing a toilet, such as a grey water toilet. The method of flushing the toilet includes opening a first valve to introduce a first supply of water into a bowl from a, tank, the bowl having an outlet that is in fluid communication with an inlet of a passage; opening a second valve to introduce a second supply of water into the passage to prime a siphon; closing the second valve to shut off the second supply of water; evacuating the contents of the bowl through an outlet of the passage by way of the siphon generated by the introduction of the first supply of water and the introduction of the second supply of water; and closing the first valve to shut off the first supply of water.

The method may further include an actuator, the actuator being configured to open the first valve and the second valve upon actuation. The first supply of water may be fresh water, and the second supply of water may be fresh water or grey water.

DETAILED DESCRIPTION

Figure 1:
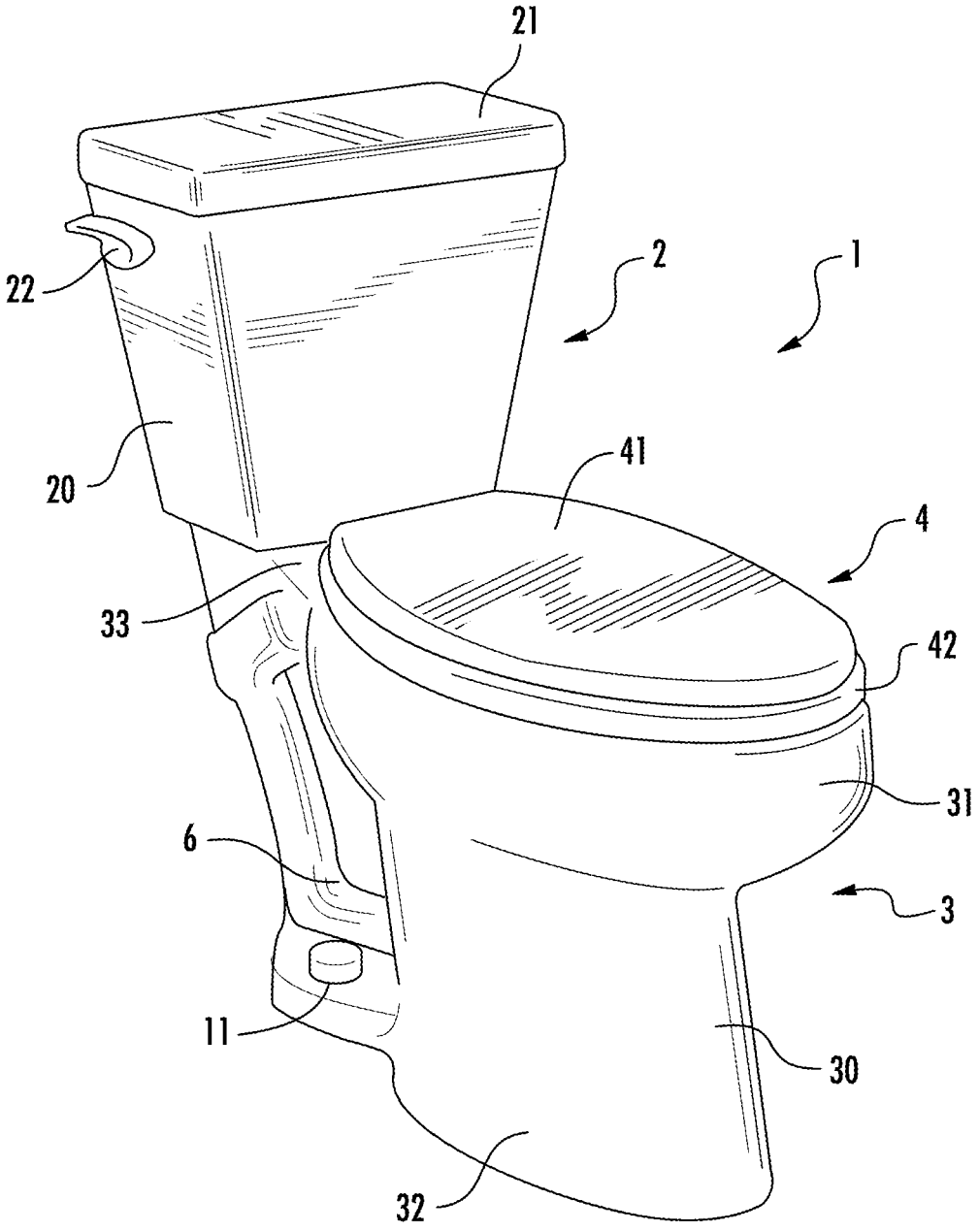
FIG. 1 is a perspective view of an exemplary embodiment of a toilet configured to utilize grey water during operation.

Referring generally to the Figures, disclosed herein are toilets that are configured to utilize a first source of water, such as, for example, fresh water delivered to a bowl, and a second or alternative source of water, such as, for example, grey water delivered to the passage of the toilet during operation of a flush cycle. For example, the toilets disclosed herein may utilize a first source of fresh water introduced into the bowl and a second source of grey water introduced into the passage during operation of a flush cycle. This allows the toilets disclosed herein to use a reduced amount of fresh water during each flush cycle of the toilet in order to reduce the overall consumption of fresh water used by the toilet. Alternatively, the toilets disclosed herein may utilize a first source of fresh water introduced into the bowl and a second source of fresh water introduced into the passage, such as when the supply of grey water is low or out, during operation of a flush cycle.

The term "grey water" as used herein includes alternative sources of water, such as unpurified water that has been captured (e.g., rainwater, salt water, etc.), recycled water (e.g., used shower and/or bath water, dishwasher, clothes washer, etc.), and other sources of non-potable water (e.g., city sourced "purple pipe" non-potable water, etc.). For example, the term "grey water" as used herein includes, but is not limited to, unpurified water such as captured rainwater, recycled water from another appliance and/or plumbing fixture, such as a shower, bath, dishwasher, sink, washing machine, etc., and the like. The term "fresh water" includes, but is not limited to, potable water that is typically safe for consumption by people and may be subject to various regulations, treatment requirements, etc.

The toilets may include a grey water system that delivers (e.g., introduces) the grey water into the toilet, such as during a flush cycle. The grey water may be introduced into the toilet on the waste side of the toilet bowl downstream of the water seal, such as into the passage forming the trapway that fluidly connects the bowl of the toilet to a drain pipe. The grey water systems may also include storage devices that hold captured grey water for use in the toilet. The grey water systems may also include collection devices that capture the grey water and deliver the captured water to, for example, the storage device.

The toilets disclosed herein may be configured to receive an amount of "grey water" on the waste (e.g., septic) side of the tank in order to "prime" the siphon pipe of the toilet and reduce the amount of "fresh" (e.g., potable) water, required to effectively evacuate the waste material from the toilet during a flush cycle. During the flushing cycle, the grey water remains on the waste or septic side of the toilet plumbing fixtures (e.g., on the waste or septic side of a toilet trap, weir, siphon pipe, passage, trapway, etc.).

The toilets, as disclosed herein, utilizing grey water during a flush cycle provide several advantages, only some of which are discussed. First, the grey water toilet systems disclosed herein may advantageously reduce the amount of fresh water required during each flush cycle, such as by using a volume of grey water in each flush cycle. Second, the grey water toilet systems disclosed herein may comply with government regulations, treatment requirements, etc., since the grey water is configured to remain on the waste side of the system. For example, should grey water be introduced into the toilet bowl (rather than the waste side of the siphon pipe), the grey water would typically need to be treated, filtered, cleaned, etc. to meet various water regulations. Maintaining the grey water on the waste or septic side of the system may avoid many or all of these regulations. Accordingly, the toilets disclosed herein may advantageously not require any additional maintenance by the consumer (e.g., the home owner) relative to level of maintenance for a conventional toilet. For example, the toilets disclosed herein do not require the periodic (e.g. weekly, monthly, etc.) replacement of filters or the addition of chemicals to treat the water to ensure it is safe to use. Third, the configuration (e.g., size, shape, etc.) and aesthetics of the grey water toilet are not adversely impacted by the introduction of the grey water system, since the elements or components, such as the storage device, may be integrated into an existing toilet or may be located remote from the toilet. Consumers of the toilets disclosed herein will also not be able to detect that grey water is being used, since the toilets will not emit any additional odors beyond that of a conventional toilet. Further, the actuators that initiate the flush cycles of the toilets disclosed herein may be configured to function using existing methods. For example, the flush cycles of the toilets disclosed herein may be activated by a handle (e.g., a pivoting handle), a lever (e.g., a lift lever), a button (e.g., a push button), or any other conventional actuation device.

Thus, from a consumers' perspective, the toilets disclosed herein may advantageously look and be operated like any other toilet.

Furthermore, utilizing grey water during a flush cycle may not only reduce the amount of fresh water required during a flush cycle (e.g., from approximately 1.28 gallons per flush to approximately 0.25 gallons per flush), but also maintain and or even increase the effectiveness of the flush cycle, such that the total volume of water required (e.g., less than 1.25 gallons, approximately 1.0 gallon, etc.), including both fresh and grey water, may be the same or even less than the volume of fresh water required by more conventional toilets that utilize a standard flush cycle.

FIG. 1 illustrates an exemplary embodiment of a toilet 1 that includes a tank 2, a pedestal 3 (or base), and a seat assembly 4. The tank 2 may include a hollow container 20 for storing the water (e.g., fresh water, grey water) used during operational (e.g., flushing) cycles of the toilet 1, a lid (e.g., cover) 21 for providing selective access into the container 20, and an actuator 22 that is configured to initiate an operational (e.g., flush) cycle when activated. The actuator 22 may be a button configured to activate when depressed (or pulled) a predetermined distance or when touched (e.g., touch sensitive button), a lever configured to activate when rotated a predetermined angular travel, or any suitable device configured to activate based upon an input manipulation by a user. The actuator 22 may be disposed anywhere on the tank 2, may be provided on another component of the toilet 1, such as the base, or may be located remotely from the toilet, such as on a wall or fixture near the toilet.

The tank 2 may include an inlet opening (not shown) configured to receive water (e.g., fresh water) from a coupled water supply (not shown), such as through a hose (e.g., line, tube)). In other words, the tank 2 may receive a supply of fresh water through the inlet from a fresh water source, which may be a water line of the dwelling in which the toilet 1 is installed. The tank 2 may also include an inlet valve assembly (not shown) or other device configured to control the flow of fresh water from the fresh water source or supply into the tank through the inlet.

The pedestal 3 (or base) of the toilet 1 may include a wall 30 having any suitable shape that is configured to form a bowl 31 (as shown in FIG. 1) having an opening formed by an upper rim at the top of the opening. The bowl 31 may be configured to include a receptacle (e.g., sump) and an outlet opening (e.g., exit 35 shown in FIG. 5), wherein the water and waste is collected in the receptacle until being removed through the outlet opening, such as upon activation of the actuator 22. The pedestal 3 may also be configured to include a plurality of walls having varying shapes that together form a bowl having an opening formed by a rim. The wall 30 (or walls) of the pedestal may extend downward and/or rearward from the bowl 31 to form a lower portion 32 configured to support the pedestal 3 and the toilet 1.

The pedestal 3 may also include a top member 33 that extends between two sides of the wall 30 (or between two opposing walls) and is provided rearward (or behind) the bowl 31, such as, for example, the rim, wherein the top member 33 forms a plateau for supporting the tank 2, such as a bottom surface of the container 20 of the tank 2. The plateau formed by the top member 33 may also provide for coupling of the seat assembly 4 to the pedestal 3 of the toilet 1. For example, the top member 33 may include one or more than one opening, wherein each opening is configured to receive a fastening device (e.g., bolt, screw, etc.) to couple (e.g., attach) the seat assembly 4 to the top member 33. As another example, the top member 33 may include one or more than one fastening device (e.g., bolts, recessed nuts, etc.) integrally formed therein (i.e., already provided connected or coupled to the pedestal 3), wherein the fastening device may be used to couple or secure at least a portion of the seat assembly 4 to the pedestal 3.

The seat assembly 4 may include a cover member 41 (e.g., lid), a seat member 42 (e.g., ring member), and a hinge (not shown in FIG. 1). The seat member 42 may form an annular member that encircles an opening, wherein the annular seat member 42 provides a seating surface for the user of the toilet 1. The seat member 42 may also be pivotally coupled (e.g., attached) to the hinge, wherein the seat member may rotate (or pivot) about the hinge, such as between a first lowered or seated position and a second raised or upright position. The cover member 41 may be configured to be round, oval, or any other suitable shape. Typically, the profile or shape of the outer surface of the cover member will be configured to complement or match (i.e., to be substantially similar to) the profile of the outer surface of the seat member to improve the aesthetics of the seat assembly 4 and toilet 1. The cover member 41 may also be coupled to the hinge, wherein the cover member 41 may rotate (or pivot) about the hinge, such as between a first down or lowered position and a second raised or upright position. The cover member 41 may be provided above the seat member 42 in the down position to thereby cover the opening of the seat member 42, as well as to conceal the inside of the bowl 31 of the pedestal 3. The cover member 41 may be configured to rest against the outside surface of the tank 2, when the cover member 41 is in the upright position, such that the cover member 41 remains in the upright position in order for a user to sit upon the seat member 42.

It should be noted that the shapes and configurations of the tank, pedestal, and the seat assembly, may vary from the embodiments shown and described herein, and that the embodiments disclosed herein are not limiting. It is also noted, for example, that although the exemplary embodiment of the toilet 1 is shown configured with the tank 2 formed separately from the pedestal 3 and later coupled to the pedestal, the tank 2 may be integrally formed with the pedestal 3 as a one-piece design. In other words, the toilet 1 may be a one-piece design, a two-piece design, or have any suitable configuration. The grey water toilets as described herein may be used with a wide variety of toilet configurations, and all such configurations are intended to be encompassed herein. The following description of various toilet features is therefore intended as illustration only of various examples, and it should be understood by those reviewing the present description that similar concepts or features may be included in various other embodiments.

Figure 2:
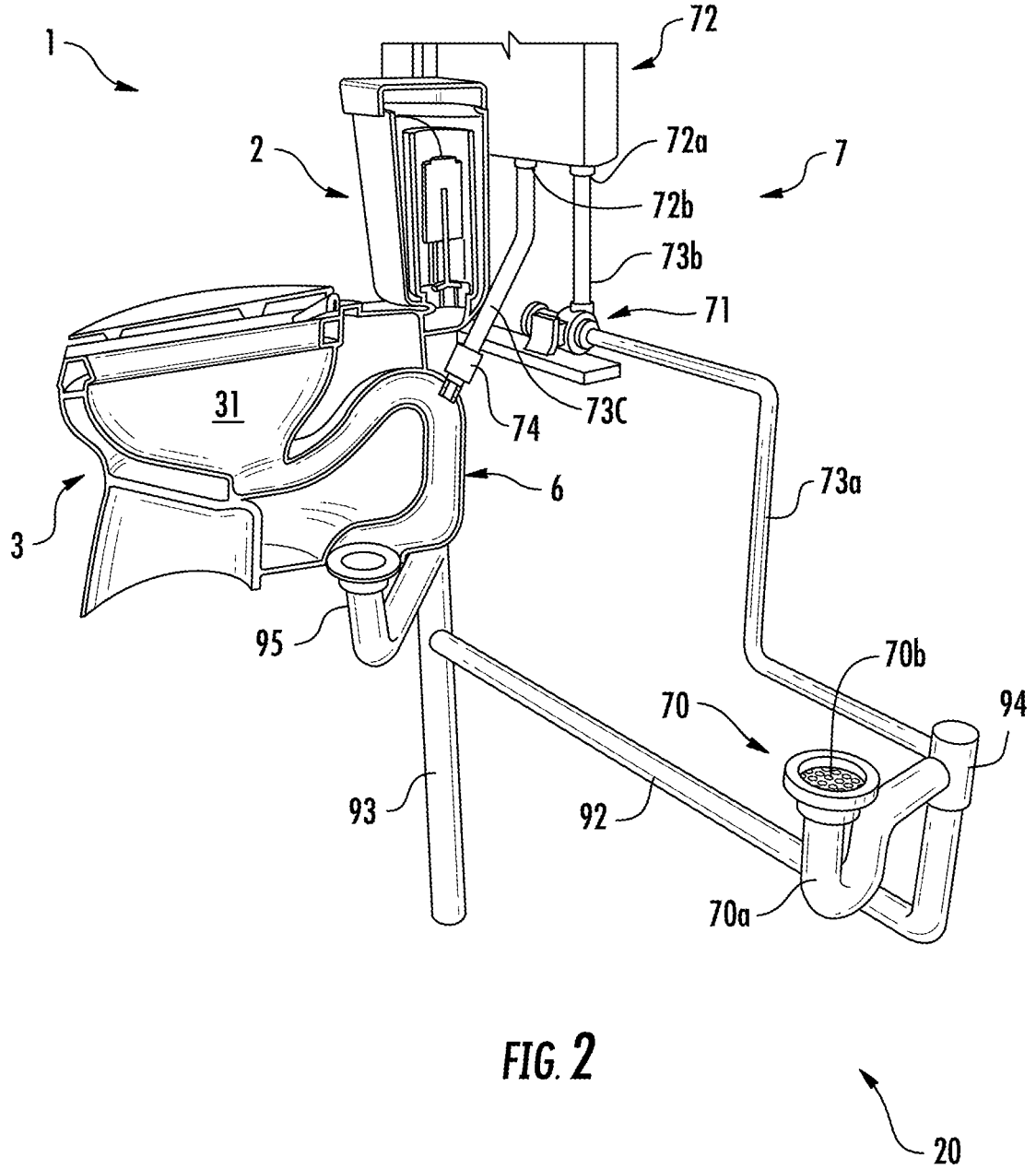
FIG. 2. is a partial-sectional perspective view of an exemplary embodiment of a toilet configured to utilize grey water during operation.

As shown in FIGS. 1 and 2, the toilet 1 includes a passage 6 (e.g., a trapway) that is configured to extend from the bowl 31 (e.g., the exit or outlet) to a drain pipe 95 (e.g., soil pipe), such as, for example, provided in the floor of the building (e.g., structure, dwelling, etc.) in which the toilet 1 is being installed. As shown in FIG. 2, the toilet 1 may be configured as a siphoning toilet, where the passage 6 is configured as a siphoning trapway to create a siphon during a flushing cycle to evacuate the waste contents from the bowl 31 to the drain pipe 95.

Also shown in FIG. 1, the toilet 1 may include a fastening system 11 for attaching the toilet 1 to a fixture of the building, such as to the floor. The fastening system 11 may include one or more than one fastener (e.g., bolt, screw, etc.), where each fastener engages a hole in the pedestal 3 to thread to another fastener (e.g., a nut) that is coupled to the drain pipe and/or the floor. It should be noted that the toilets 1 disclosed herein may utilize any suitable fastening system, and the examples disclosed herein are not limiting.

The toilet (e.g., toilet 1) may also include a grey water system that introduces the grey water into the toilet. The grey water system may optionally be configured to capture and store the grey water. According to an exemplary embodiment, the grey water system includes a collection device that is configured to capture or collect the grey water, a storage device that is configured to store the collected grey water prior to use, and a delivery device that is configured to introduce the grey water into the toilet during a flush cycle. It is noted that the toilets disclosed herein may include any one of any combination of the delivery, storage, and collection devices/systems.

FIGS. 2-5 illustrate an exemplary embodiment of a toilet 1 having a grey water system 7 that is configured to introduce captured grey water into the passage 6 (e.g., the trapway) of the toilet 1 during a flush cycle. The grey water system 7 includes a collection device 70 in the form of a pipe 70*a*, and a drain 70*b* that is configured to capture shower water from the bath/shower. The grey water system 7 may also include a pump 71 or other suitable device that is configured to move, such as through fluid pressure, the recycled shower water from the collection device 70 to a storage device 72. As shown the storage device 72 is configured as a tank or container that is configured to hold a specified volume of grey water therein. The size (e.g., volume) of the storage device 72 may be varied, such as, for the anticipated use of the toilet. In other words, the volume that the storage device 72 can hold may be tailored to the specific application or type of dwelling in which the toilet is installed. For example, for a typical residential dwelling, the storage device 72 may be configured to hold approximately 10-40 gallons of grey water, where for a commercial dwelling expecting a greater usage of the toilet, a relatively larger tank (e.g., one that is configured to hold 40-100 gallons or more) may be provided. It is noted that these volumes disclosed are examples, and are not limiting, as the storage devices may be configured to hold any volume of grey water therein. For example, it may be ideal to size the tank such that the stored volume of grey water is used by the toilet within a specific period of time (e.g., one day, one week, etc.).

According to an exemplary embodiment, the storage device 72 includes an inlet 72*a* and an outlet 72*b*. The inlet 72*a* is configured to receive the grey water from the collection device 70, such as through a conveyor, which may include a pipe or a plurality of pipes. As shown in FIG. 2, a first pipe 73*a* transfers the grey water from the collection device 70 to the pump 71, and a second pipe 73*b* transfers the grey water from the pump 71 to the storage device 72. Thus, the second pipe 73*b* may be connected to and in fluid communication with the inlet 72*a* of the storage device 72. The outlet 72*b* of the storage device 72 is configured to introduce the stored grey water to the passage 6. As shown in FIG. 2, a third pipe 73*c* transfers the grey water from the storage device 72 through the outlet 72*b* to the passage 6. The storage tank 72 may also be vented through the plumbing network. The storage device 72 may optionally include a fresh water inlet to provide a source or supply of fresh water, such as in the event the grey water runs low or is used up.

The toilet 1 may include a valve 74 (e.g., valve assembly) disposed between the outlet 72*b* of the storage device 72 and the passage 6, where the valve 74 controls the flow (e.g., the volume, the time, etc.) of the grey water from the storage device 72 to the passage 6. For example, the valve 74 may be in-line with the third pipe 73*c*. The valve 74 is configured to open and close to permit or prohibit (e.g., shut-off) the flow of the grey water therethrough. The valve 74 may be controlled mechanically, electronically, or a combination thereof. For example, the actuator 22 may be configured to control the operation of the valve 74 through a mechanical feature, such as a lever arm. As another example, the actuator 22 may be configured to activate an electronic device upon actuation, where the electronic device controls the valve 74. As yet another example, the actuator 22 may be a button that is configured to send an electronic signal to a solenoid (or other suitable device) upon being depressed, where the solenoid controls the opening and closing of the valve 74. The timing of the valve 74, such as when to open and when to close, may be varied to tailor the operation of the valve to the performance of the toilet. For example, the valve 74 may be opened approximately one to two seconds prior to the siphon.

The grey water system 7 may also include a dispensing subsystem 90 for dispensing excess or additional grey water, such as when the storage device 72 is full. The dispensing subsystem 90 may include one or more than one pipe to dispense the excess grey water.

Figure 3:
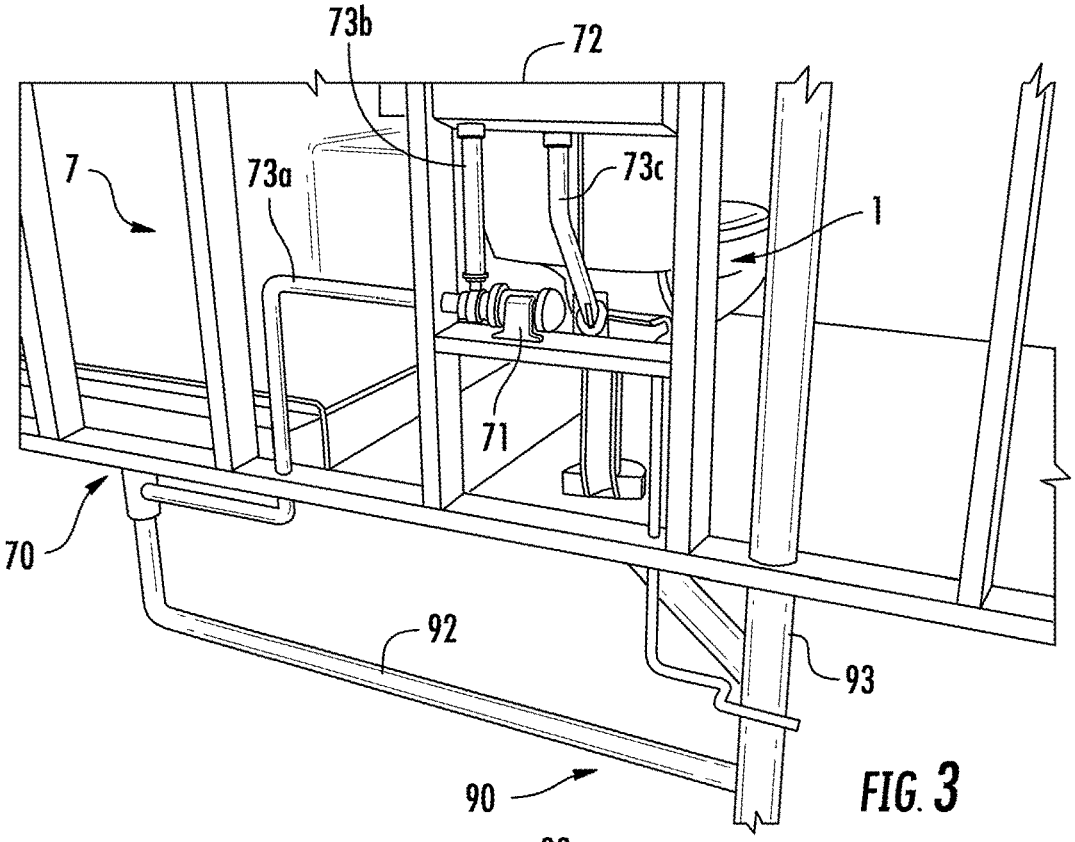
FIG. 3 is a rear perspective view of the toilet of FIG. 2.
Figure 4:
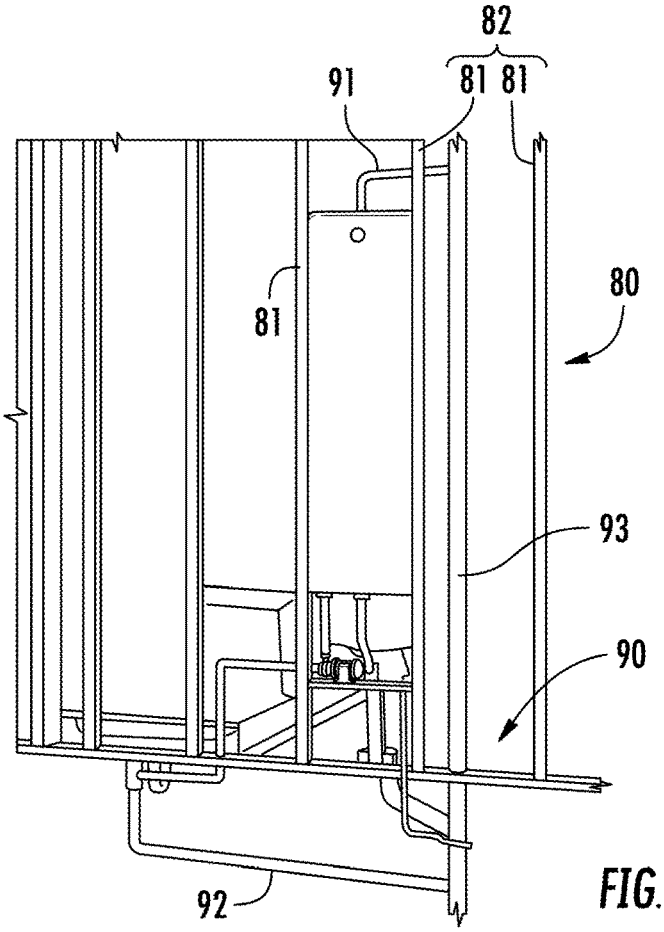
FIG. 4 is another rear perspective view of the toilet of FIG. 2.

As shown in FIGS. 2-4, the dispensing subsystem 90 includes a first dispensing pipe 91, a second dispensing pipe 92, and a third dispensing pipe 93. The first dispensing pipe 91 may fluidly connect the storage device 72 and the third dispensing pipe 93. For example, the first dispensing pipe 91 may be provided at a top portion of the storage device 72 in order for excess grey water to drain from the storage device 72 when the storage device is full. As shown, the first dispensing pipe 91 extends upwardly from the top of the storage device 72.

The second dispensing pipe 92 may fluidly connect the collection device 70 and the third dispensing pipe 93. For example, the second dispensing pipe 92 may be configured to direct excess grey water to the third dispensing pipe 93 when the storage device 72 is full of grey water. The second dispensing pipe 92 may extend from a fitting 94, such as a three-way (e.g., tee) fitting, which interconnects the first pipe 73*a* of the grey water system, the second dispensing pipe 92 and a collection pipe 70*a*. The third dispensing pipe 93 may also be in fluid communication with the drain pipe 95, which may be connected to a municipal sewer system or a septic sewer system.

The dispensing subsystem 90 may be configured differently than shown and still provide for the effective handling and removal of excess grey water. Additionally, the grey water system 7 may be configured to repurpose the grey water. For example, the grey water system 7 may advantageously be configured so that the movement of the grey water through the system helps remove debris (e.g., sludge, sediment, etc.) from the captured grey water in the tank. The overflow of the tank may act as a skimming device as grey water is moved through the tank to help remove any debris. As another example, the excess grey water can be directed into the trap to help with drain line carry. This arrangement may help alleviate flow problems, which can be problematic in conventional low flow toilets, such as by supplying additional water that would not otherwise be available to the waste line, which may advantageously provide a more reliable unit that is less susceptible to clogging or plugging in the waste line (e.g., drain pipe 95).

The grey water system 7 may be installed within the infrastructure of the dwelling, such as for new builds, or may be retrofitted into the structures of existing dwellings. For example, the grey water system 7 may be installed within a wall 80 (or walls) of the infrastructure of the dwelling. As shown in FIG. 4, the storage device 72 of the grey water system 7 is installed between two studs 81 of a frame 82 of the wall 80. The pipes of the grey water system 7 may be routed within or behind the walls to improve the appearance of the washroom by hiding the plumbing.

Figure 5:
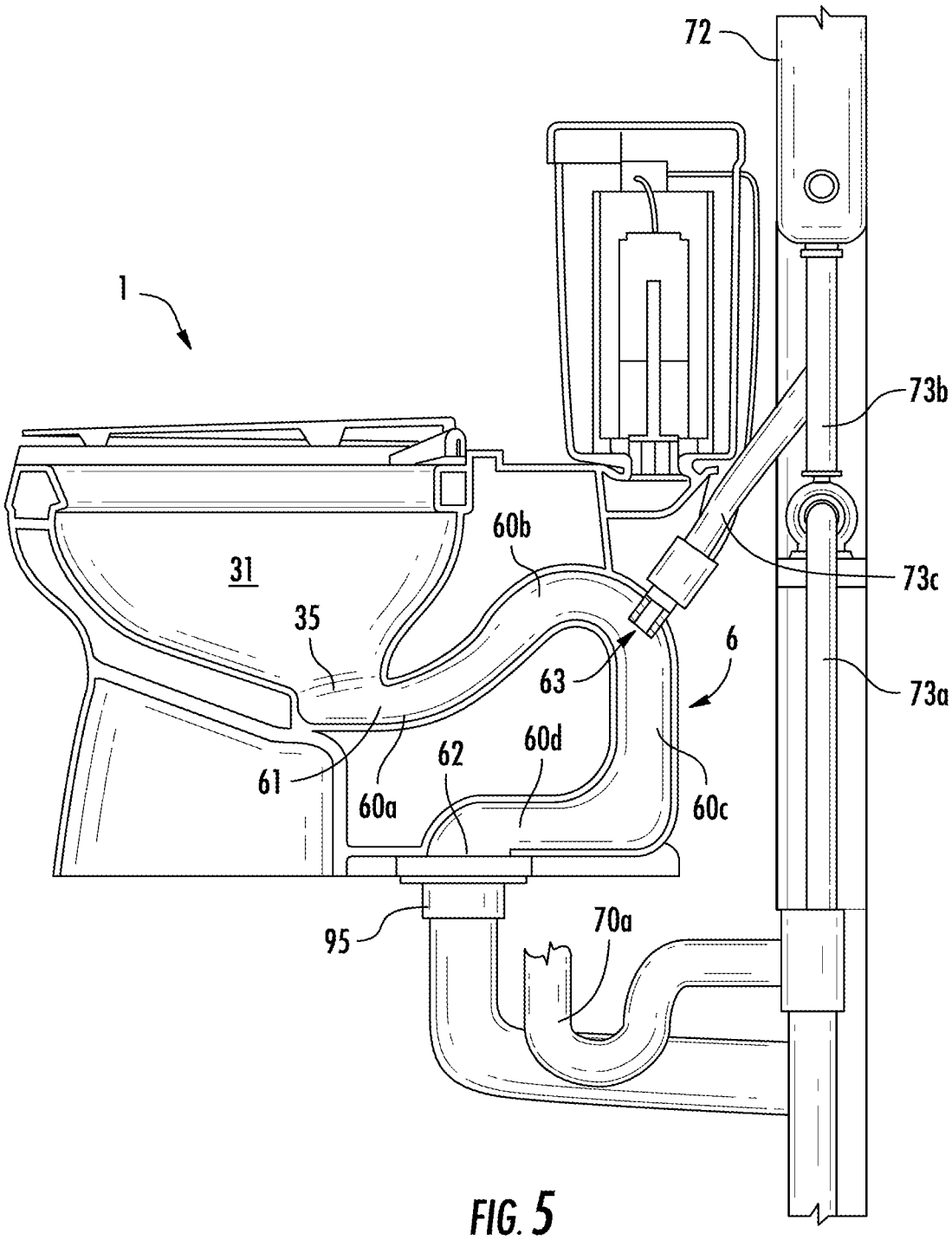
FIG. 5 is a side-sectional view of the toilet of FIG. 2.

FIG. 5 illustrates an exemplary embodiment of the toilet 1 having the passage 6, which is configured to carry the waste and fluid from the bowl 31 to the drain pipe 95. The passage 6 may be configured having an irregular shape (e.g., U-shape, S-shape, etc.), including a generally tubular cross-section (e.g., circular, oval, etc.). As shown in FIG. 5, the passage 6 includes a first end 61 (e.g., an entrance), a second end 62 (e.g., an exit), and an inlet opening 63 provided between the first end 61 and the second end 62. The first end 61 is in fluid communication with the exit or outlet 35 of the bowl 31. The second end 62 is in fluid communication with the drain pipe 95 to discharge the waste and fluid from the toilet 1. The inlet opening 63 is configured to introduce the grey water into the passage 6 from the storage device 72.

Figure 6:
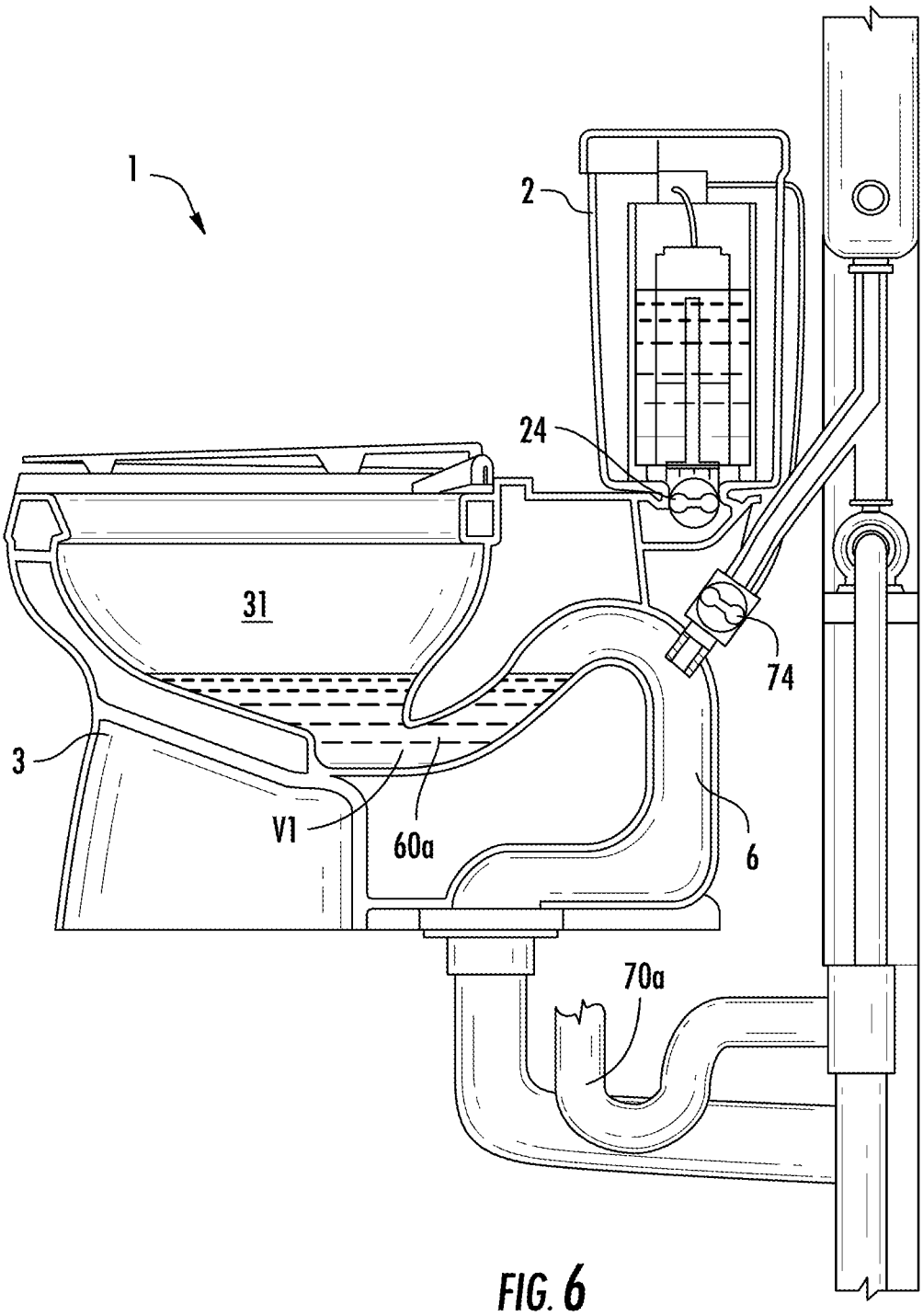
FIG. 6 is a side-sectional view of the toilet of FIG. 2 showing a first phase of operation.

The passage 6 may extend from the first end 61 in a generally rearward direction forming a first portion 60*a* (e.g., an up-leg) of the passage 6. The passage 6 may have a second curved portion 60*b* having an inverted U-shape. As shown in FIG. 6, an upper section of the inverted U-shaped second curved portion 60*b* is disposed at a height that is higher than the first portion 60*a* of the passage 6 and a lower portion of the bowl 31 (e.g., a sump) in order for a volume of fresh water to remain in the bowl 31 following a flush cycle. Thus, the bottom surface of the upper section of the second portion 60*b* of the passage 6 may be at a height that determines a water level (e.g., of the fresh water) in the bowl after completion of a flush cycle, as shown in FIG. 6. In other words, the second portion 60*b* of the passage 6 may act as a weir (e.g., dam) to capture a volume of fresh water in the bottom of the bowl 31. The passage 6 may have a generally vertical third portion 60*c* (e.g., a down-leg) that extends from the second portion 60*b* downwardly toward the second end 62. The passage 6 may include a fourth portion 604 that extends generally in a forward horizontal direction from the third portion 60*c*.

According to the exemplary embodiment shown in FIG. 5, the inlet opening 63 is located in a rearward portion of the curved second portion 60*b*, which may advantageously allow the grey water to be introduced into the passage 6 with gravity acting to move the grey water down through the third portion 60*c* toward the second end 62 of the passage 6. This arrangement may advantageously influence (e.g., induce) the siphoning effect of the toilet 1 during a flush cycle.

The inlet opening 63 may be provided at a lower rearward section of the second curved portion to advantageously prohibit the grey water from back-flowing into first portion 60*a* of the passage 6. For example, the inlet opening 63 is provided at a location that is level or below the upper peak of the bottom surface of the second portion 60*b*, such as near the transition between the second curved portion 60*b* and the third portion 60*c*. This arrangement may advantageously comply with government regulations related to the water (e.g., purity) in the bowl by prohibiting the grey water from back-flowing into first portion 60*a* of the passage 6.

According to another exemplary embodiment, the inlet opening 63 is provided at a location in the third section of the passage 6. According to yet another exemplary embodiment, the inlet opening 63 is positioned as high as possible to maximize the siphon in the third portion 60*c*. This arrangement may advantageously minimize the amount of air within the passage 6, such as between the inlet opening 63 and the residing water in the bowl 31 and first portion 60*a* of the passage 6. The passage 6 may seal (e.g., the valve 74 may be closed), for example, once the third portion 60*c* is primed with water, to induce a siphon or siphoning in the passage 6.

FIGS. 6-9 illustrate an exemplary embodiment of a five step flush cycle of a grey water toilet, such as the toilet 1. In other words, FIGS. 6-9 show a method of flushing the toilet that involves five steps or processes. As shown in FIG. 6, prior to the flush cycle, a volume V1 of fresh water is provided in the bottom of the bowl 31 (remaining following the previous flush cycle), and both of the valves 24, 74 are closed. Upon the user activating the flush cycle (e.g., by depressing a trip lever, pushing a button, etc.), the first step involves opening the valve 74 (e.g., a first valve) to introduce a supply of grey water into the passage 6 to prime a siphon. The second step involves opening a second valve 24 to introduce a supply of fresh water into the bowl 31 from the tank 2, the bowl 31 having an outlet 35 that is in fluid communication with an inlet (e.g., the first end 61) of the passage 6. The third step involves closing the first valve 74 to shut off the supply of grey water. The fourth step involves evacuating the contents of the bowl 31 through an outlet (e.g., the second end 62) of the passage 6 by way of a siphoning action. The fifth step involves closing the second valve 24 to shut off the supply of fresh water and stop the siphoning action.

Figure 7:
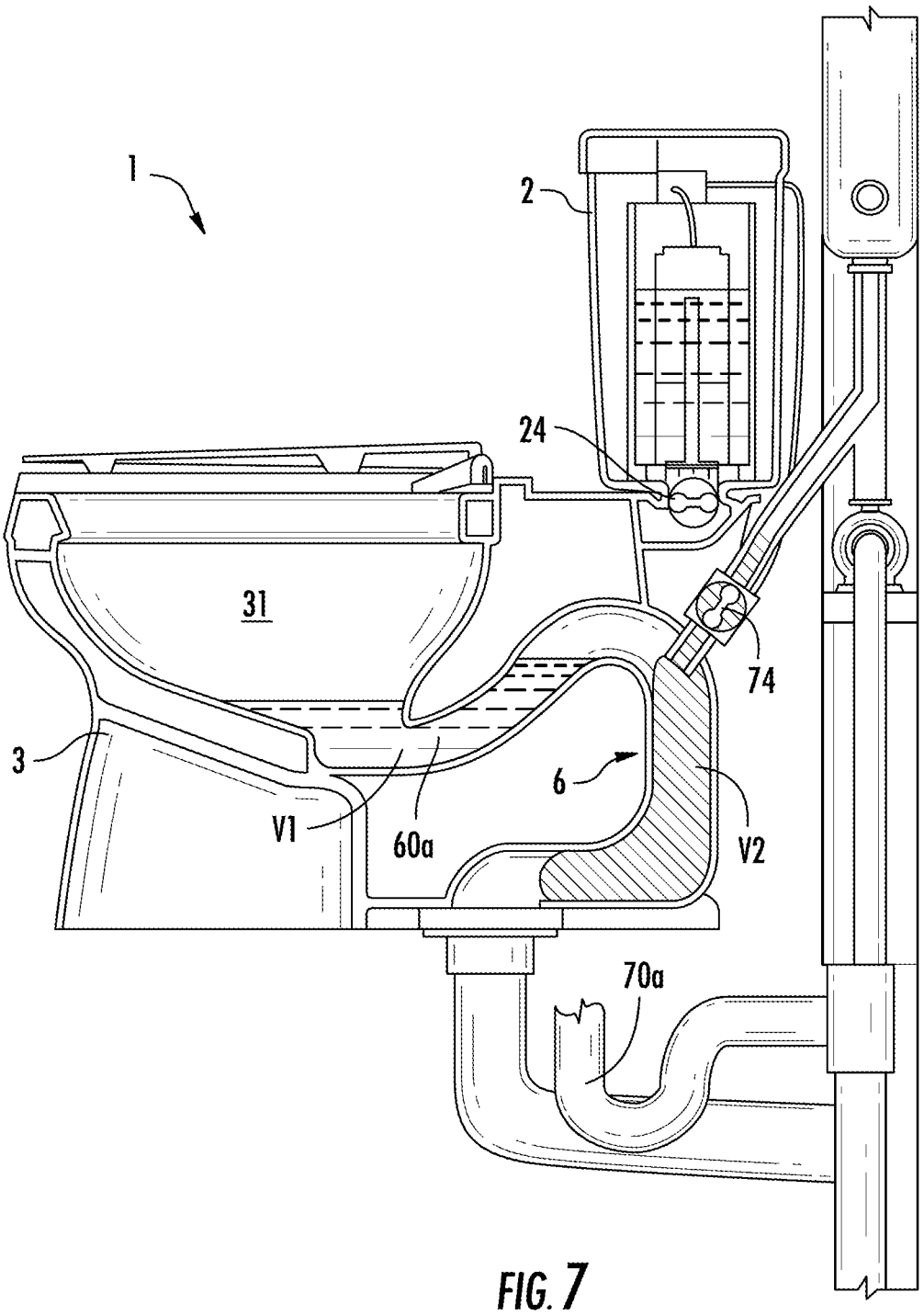
FIG. 7 is a side-sectional view of the toilet of FIG. 2 showing a second phase of operation.
Figure 8:
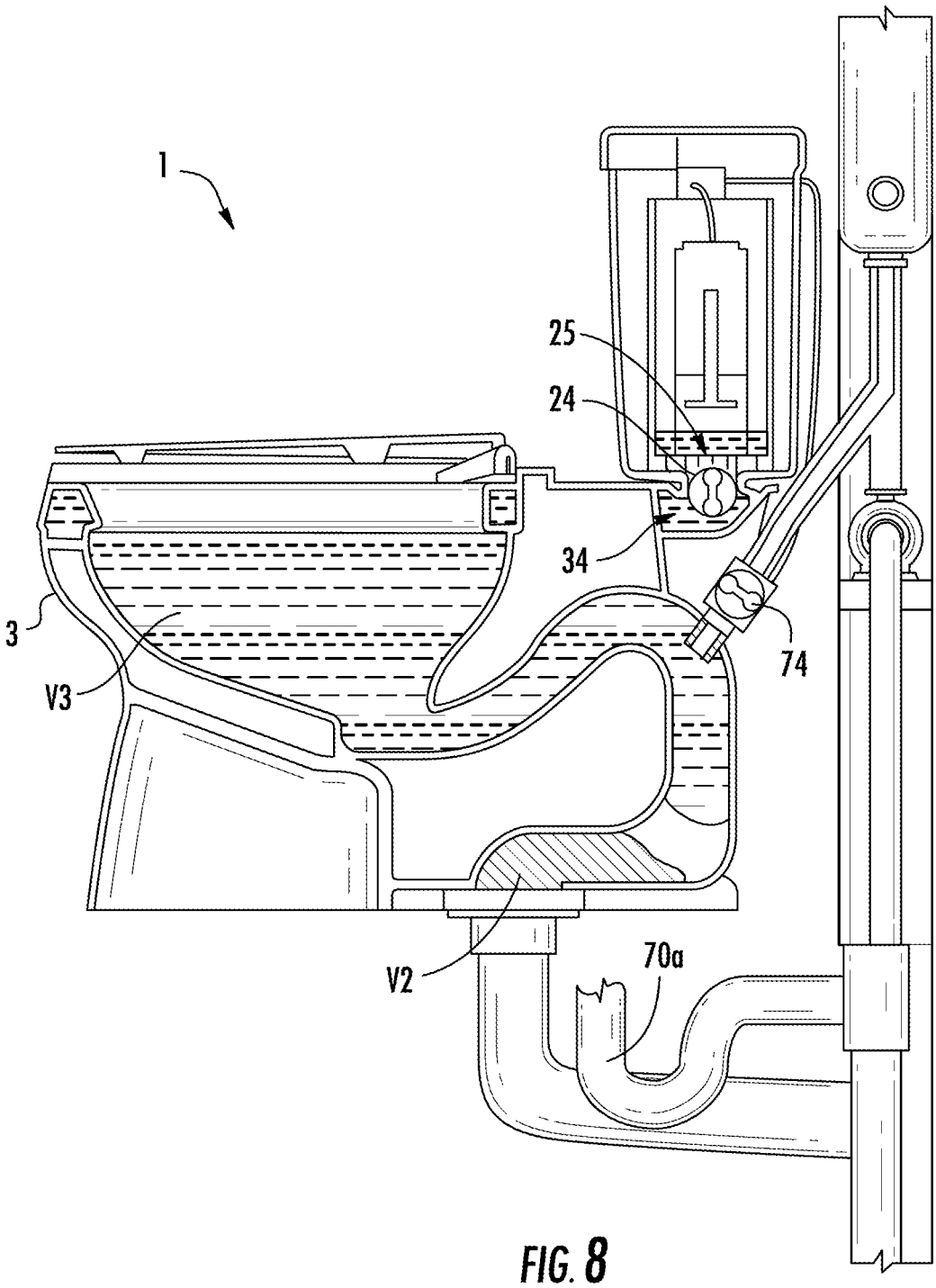
FIG. 8 is a side-sectional view of the toilet of FIG. 2 showing a third phase of operation.

As shown in FIG. 6, the toilet 1 prior to activation of a flush cycle includes an initial volume V1 of fresh water based on the water level of the toilet. The initial volume of fresh water may be provided in the lower portion of the bowl and at least a portion of the first portion 60*a* of the passage 6. The first step may be initiated by activating the actuation device, such as the actuator 22 shown in FIG. 1. For example, rotation of the actuator 22 by a first rotation (e.g., a first angle) may first initiate the opening of the valve 74 to allow grey water to flow into the passage 6. As shown in FIG. 7, once the valve 74 is opened, a volume V2 of the grey water enters the passage 6 and may flow through the third section 60*c* that extends downwardly toward the second end 62. It is noted that the cross-hatch corresponding to the volume V2 shown in FIGS. 7 and 8 represents the grey water. The grey water may be introduced prior to the introduction of the fresh water in order to prime the siphon of the toilet 1. In other words, by introducing the grey water into the passage 6 for a time period before fresh water in introduced into the bowl 31, the grey water acts to affect the siphoning of the flush cycle of the toilet 1.

The second step may also be initiated by activating the actuation device, such as the actuator 22. For example, rotation of the actuator 22 by a second rotation (e.g., a second angle) may initiate the opening of the valve 24 to allow fresh water to move from the tank 2 to the bowl 31. Also, for example, a time delay from the initial actuation may be used to trigger the opening of the valve 24. The top member 33 of the pedestal 3 may include an inlet 34 (e.g., an entrance) that may be aligned with an outlet 25 (e.g., exit) of the tank 2, such as when the tank 2 is coupled to (or resting above) the pedestal 3, wherein water (e.g., fresh water) is selectively transferred (e.g., conducted) from the tank 2 to the bowl 31 by the valve 24. Thus, the valve 24 controls the flow of fresh water from the tank 2 to the pedestal 3 (e.g., the bowl 31) for toilet 1. The toilet 1 may also include a gasket or seal (not shown) that is provided between the tank 2 and the pedestal 3 to prohibit leaking therebetween. For example, a resilient gasket may be provided between the outlet 25 of the tank 2 and the inlet 34 of the pedestal 3 to prohibit leaking between the tank and the pedestal. The tank 2 may also include a float device (not shown) or any other suitable device (e.g., canister) that controls the valve 24, such as by controlling the timing (e.g., opening) of the valve 24 to meter the flow therethrough.

The valve 24 may be configured to be opened after a time delay from when the valve 74 is opened. For example, the actuator 22 may open the valve 24 (e.g., first valve) after a time delay from when the actuator 22 opened the valve 74 (e.g., second valve). According to an exemplary embodiment, the time delay is approximately one to three seconds. Thus, for this example, the valve 74 may be opened for a time of approximately one to three seconds before the valve 24 is opened, allowing grey water to flow into the passage 6 for one to three seconds before the fresh water begins to flow into the bowl 31 from the tank 2. It is noted that the valves (e.g., the valve 24 and the valve 74) may be activated by the same actuation device as described above, or by different actuation devices. For example, the user may activate a first actuation device (e.g., a push button) which opens the valve 74, where a second actuation device, which may be actuated by the valve 74 or based on the timing of the opening of the valve 74, opens the valve 24. It is further noted that the valves may be activated having different timing relative to each other.

The third step involves closing the valve 74 (e.g., first valve) to shut off the supply of grey water flowing into the passage 6 from the storage device 72. The valve 74 may be configured to be closed mechanically, electronically, or a combination thereof. The valve 74 may be closed prior to the siphoning action to allow the fresh water flowing through the valve 24 to increase the pressure in the passage 6 to induce the siphon and/or to prevent the contents of the bowl 31 and fluid to backflow through the inlet opening 63 and into the third pipe 73*c* and/or the storage device 72. As shown in FIG. 8, after the valve 74 closes, the fresh water continues to enter the bowl 31 since the valve 24 remains open. Thus, a volume V3 of the fresh water enters the bowl 31 to induce and/or continue the siphon and to move the volume V2 of the grey water out of the second end 62 of the passage 6. As an example, the valve 74 may be a line pressure actuated pilot valve configured to actuate a main valve, which may be driven by a pressure drop when the fresh water line e.g., through the valve 24) is actuated.

The fourth step involves using a generated siphon to evacuate the contents of the bowl 31 through an outlet (e.g., the second end 62) of the passage 6. The siphon is induced by the flow of fresh water into the bowl 31 combined with the flow of grey water into the passage 6. For example, the siphon may be induced primarily by the flow of the grey water and secondarily by the flow of the fresh water. The siphon may be induced when the passage 6 fills with water (e.g., fresh water and grey water). Thus, it may be advantageous to introduce the grey water into the passage 6 to assist the fresh water in inducing the siphon of the flush cycle. The use of grey water advantageously reduces the amount (e.g., volume) of fresh water that is used during a flush cycle. The grey water may be introduced prior to the introduction of the fresh water in order to prime the siphon of the toilet 1, where the siphoning moves the contents of the bowl 31 through the passage 6 and out of the toilet through the second end 62 of the passage to the drain pipe 95. During the siphoning, the volume V2 of the grey water is flushed from the passage 6.

Figure 9:
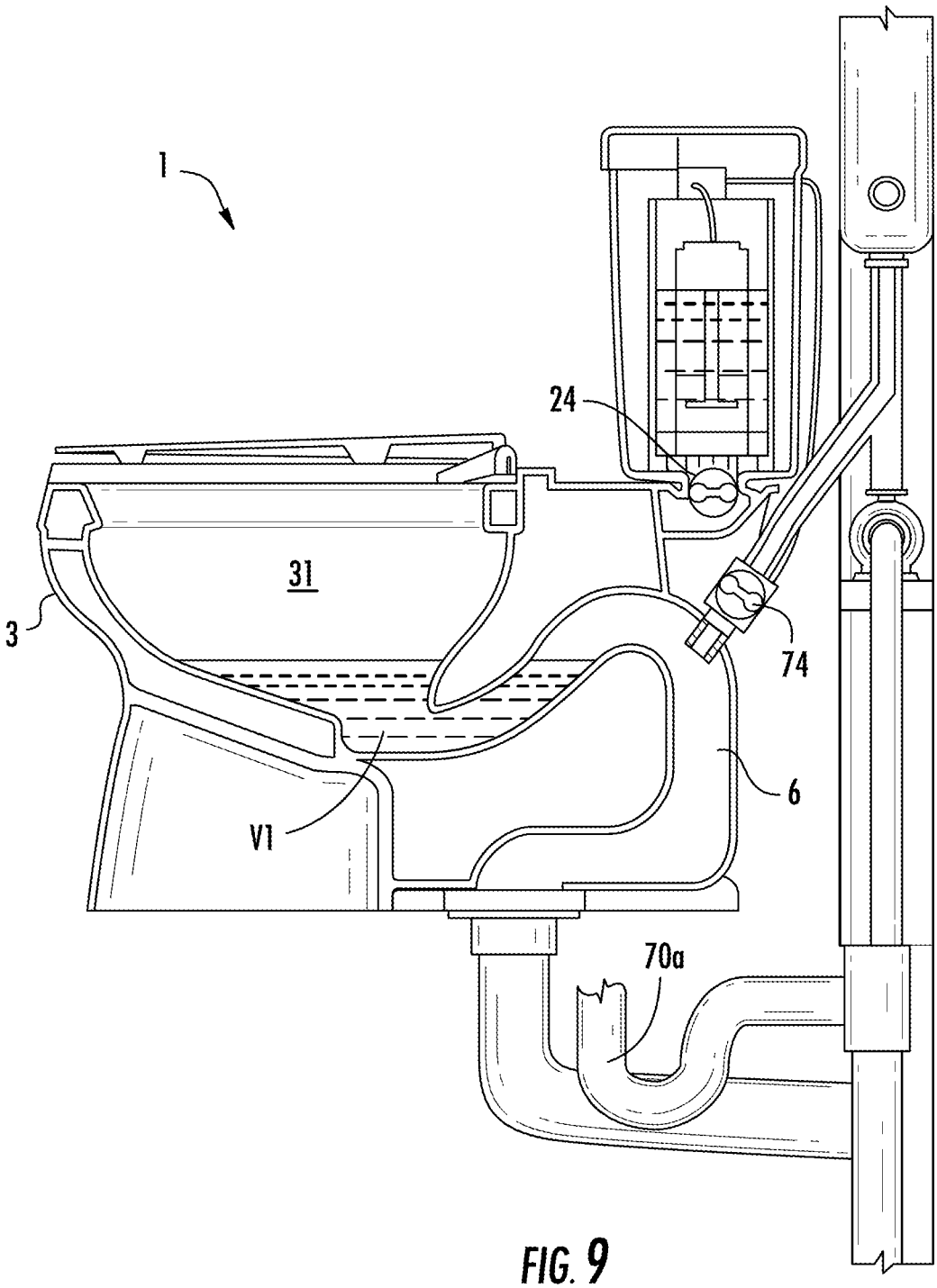
FIG. 9 is a side-sectional view of the toilet of FIG. 2 showing a fourth phase of operation.

The fifth step involves closing the second valve 24 to shut off the supply of fresh water. Fresh water continues to fill the bowl 31 after the siphoning action in order to fill the bottom of the bowl 31 and the reservoir (e.g., at least a portion of the passage 6) with a volume V1 of the fresh water. As shown in FIG. 9, once the volume V1 of the fresh water has been introduced into the bowl 31, the valve 24 is configured to close to shut off the supply of fresh water. The time delay between closing the valve 24 may be tailored depending on the toilet 1, such as to tailor the volume of water that enters the bowl 31.

The grey water toilets disclosed herein (e.g., toilets 1, 101, 201, 301, 401) may utilize a different method of flushing the toilet. For example, another exemplary method of flushing the toilet involves five steps or processes. The first step of the method involves opening a first valve (e.g., valve 24) to introduce a supply of fresh water into a bowl (e.g., bowl 31), such as, for example from a tank (e.g., tank 2), where the bowl includes an outlet that is in fluid communication with an inlet of a passage (e.g., passage 6). The second step of the method involves opening a second valve (e.g., valve 74) to introduce a supply of grey water into the passage (e.g., passage 6) to prime a siphon therein. The grey water may be introduced into an inlet opening of the passage. The third step of the method involves closing the second valve to shut off the supply of grey water. The second valve may be closed using a mechanical device, an electronic device, or a combination thereof. The fourth step of the method involves evacuating the contents of the bowl through an outlet of the passage by way of the siphon generated by the introduction of the supply of grey water and the introduction of the supply of fresh water. The fifth step of the method involves closing the first valve to shut off the supply of fresh water.

The toilets disclosed herein are configured to improve performance of the flush cycle by introducing the supply of water (e.g., grey water, fresh water) into the passage. For example, by introducing the supply of water on the waste side of the passage, a vacuum may be established within the passage. The vacuum may induce a siphon to evacuate the contents of the bowl, such as with using a reduced amount of water (in total and/or fresh water). As the supply of water (e.g., a volume of grey water) is introduced or delivered into the passage, such as the vertical section of the passage, the supply of water fills the void and falls (e.g., through gravity) through the passage, which may establish a vacuum or low pressure. The low pressure or vacuum pulls on the water (and contents) in the sump of the bowl pulling it through the passage (e.g., up and over the weir of the passage). Accordingly, by inducing a vacuum, the supply of water (e.g., a volume of grey water) introduced into the passage "primes" the passage and allows the flush cycle to use less total water (e.g., the volume of water introduced into the bowl and the volume of water introduced into the passage) compared to a toilet that introduces water only into the bowl, since the latter toilet requires additional water to push the contents of the bowl up and over the weir. By utilizing grey water for the volume of water introduced into the passage, the toilet further reduces the amount of fresh water used per flush cycle.

FIGS. 10-13 illustrate another exemplary embodiment of a toilet 101 having a grey water system 107 that is configured to introduce captured grey water into the toilet 101 during a flush cycle. The toilet 101 may be configured similar to, the same as, or different than the other toilets disclosed herein. The grey water system 107 may be configured to introduce the grey water into the passage 106 (e.g., the trapway) of the toilet 101 during a flush cycle.

Figure 13:
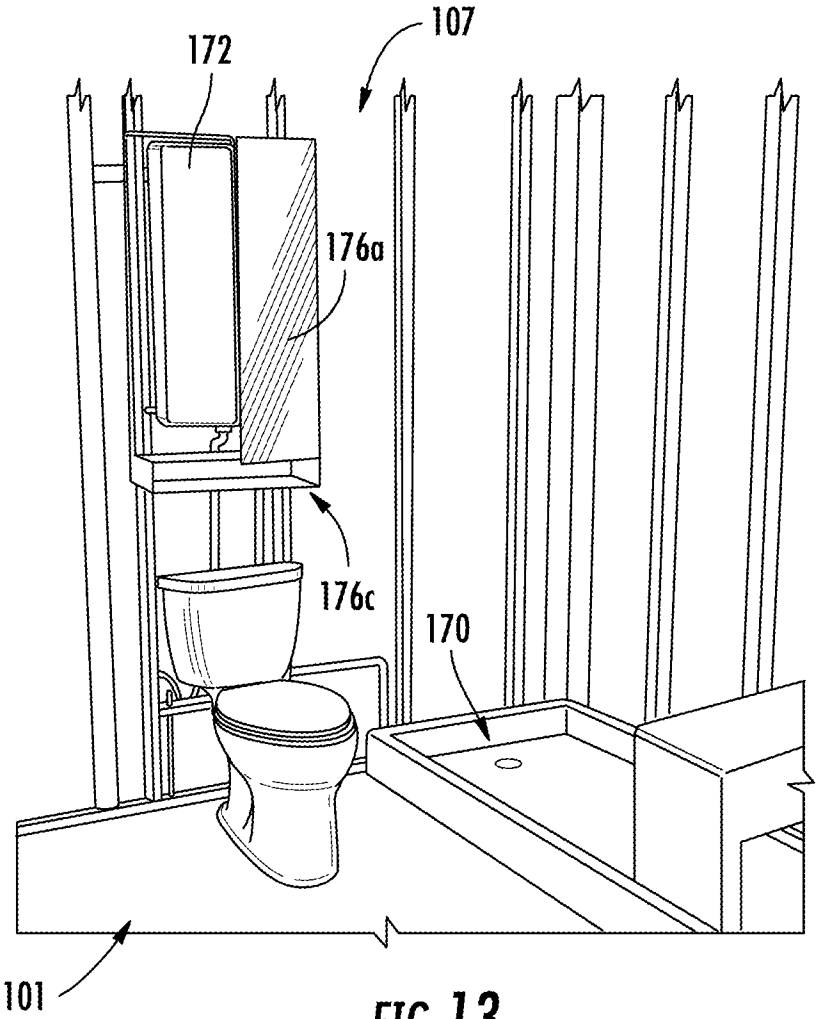
FIG. 13 is yet another perspective view of the toilet of FIG. 10.

The grey water system 107 includes a collection device e.g., the collection device 170 shown in FIG. 13) that is configured to capture shower water from the bath/shower, rain water, or any other suitable form of grey water, and a storage device (e.g., the storage device 172 shown in FIG. 11) that is configured to store the captured grey water. The grey water system 107 may also include a pump 171 (shown in FIG. 12) or any other suitable device that is configured to move the recycled shower water (e.g., the grey water) from the collection device 170 to the storage device 172.

Figure 11:
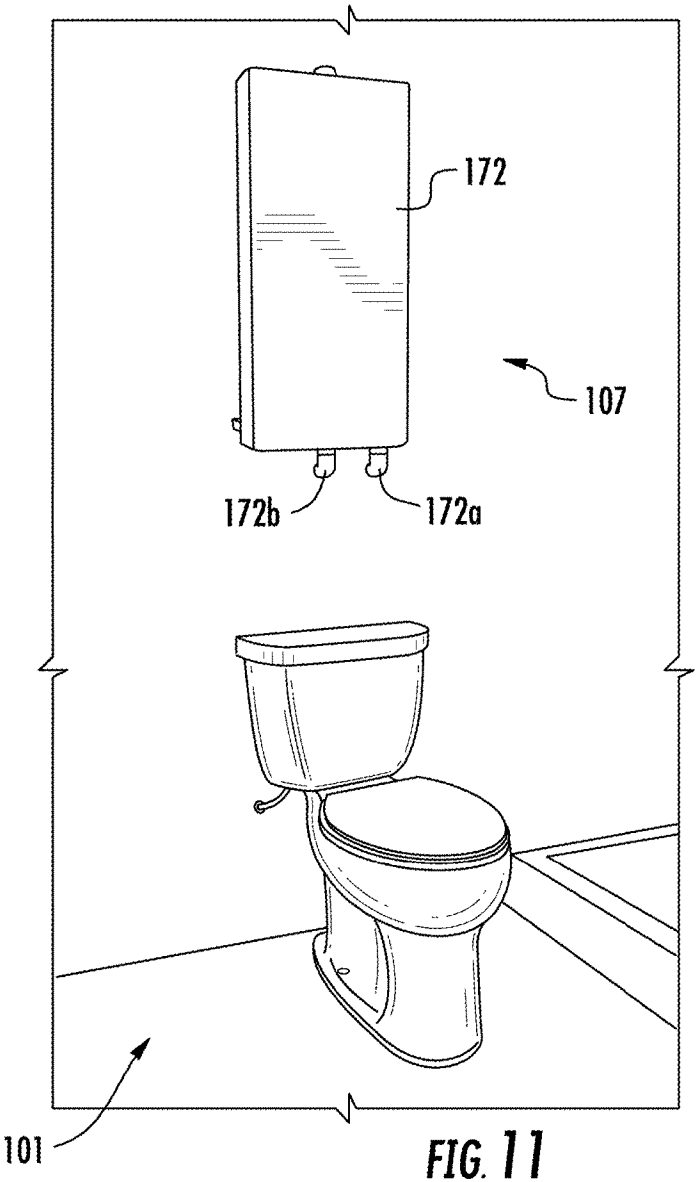
FIG. 11 is another perspective view of the toilet of FIG. 10.
Figure 10:
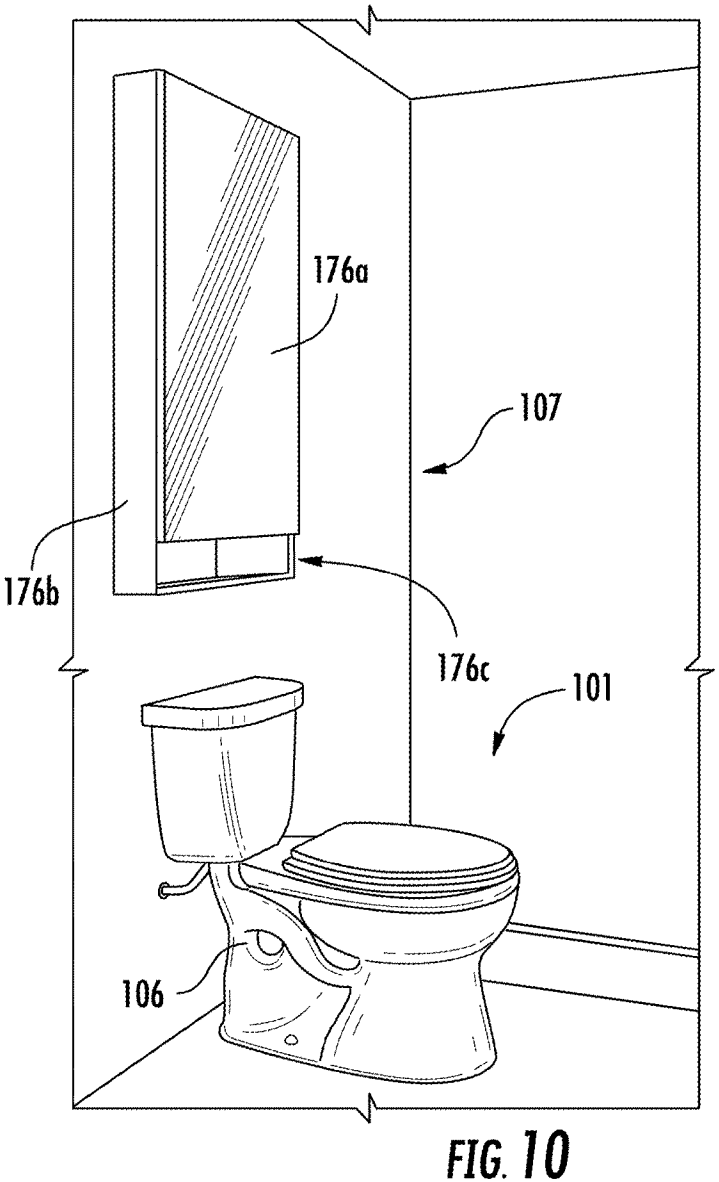
FIG. 10 is a perspective view of another exemplary embodiment of a toilet configured to utilize grey water during operation.

As shown in FIGS. 10 and 11, the storage device 172 is configured as a tank or container that is configured to hold a specified volume of grey water therein. The size (e.g., volume) of the storage device 172 may be tailored, such as, for the anticipated use of the toilet. As shown in FIG. 11, the storage device 172 may be disposed on the exterior surface of a wall, such as the wall provided behind and/or above the toilet 101. It is noted that the storage device 172 may be located anywhere in the washroom, and does not have to be provided behind the toilet 101, since the piping may transfer the grey water to the toilet 101.

Also shown in FIG. 10, the storage device 172 may be constructed within a cabinet, which may include a mirrored surface 176*a*, such as provided on a movable (e.g., pivoting) door. For example, the door having the mirrored surface may be disposed on the outside of the storage device 172 to conceal the storage device 172 and provide the added utility of the mirror. The storage device 172 may include a frame 176*b*, such as to surround and conceal the storage device 172. The cabinet (e.g., the frame 176*b*) may optionally include a shelf 176*c* for a plurality of shelves) configured to provide storage space.

Figure 12:
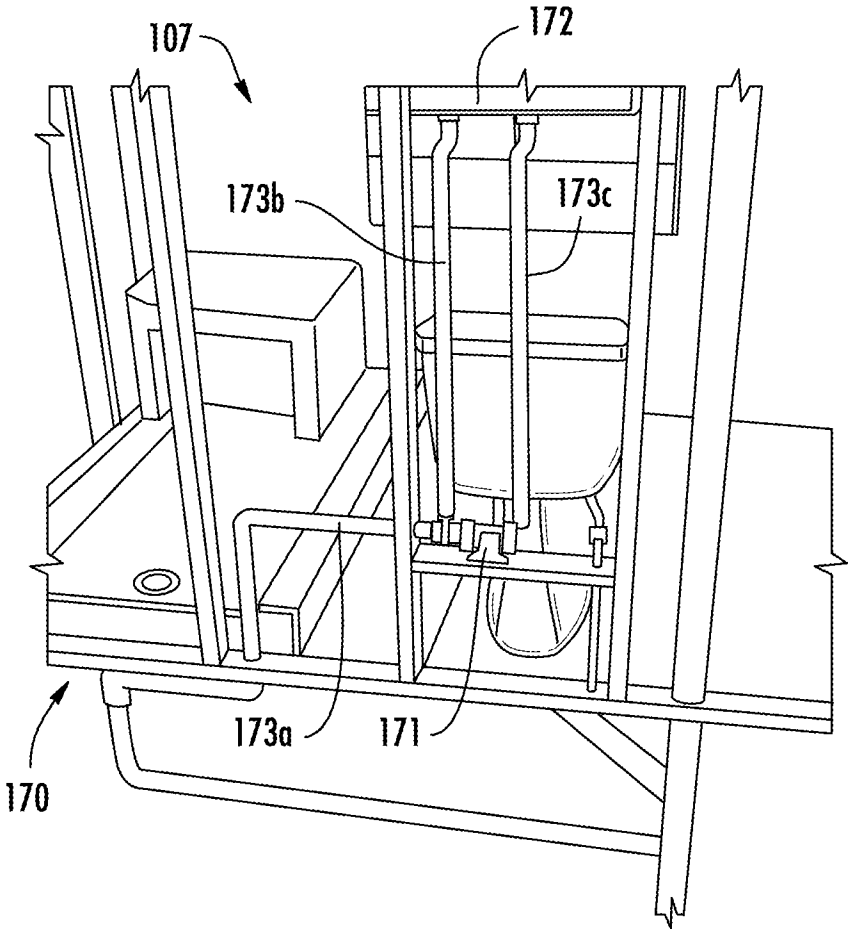
FIG. 12 is another perspective view of the toilet of FIG. 10.
Figure 14:
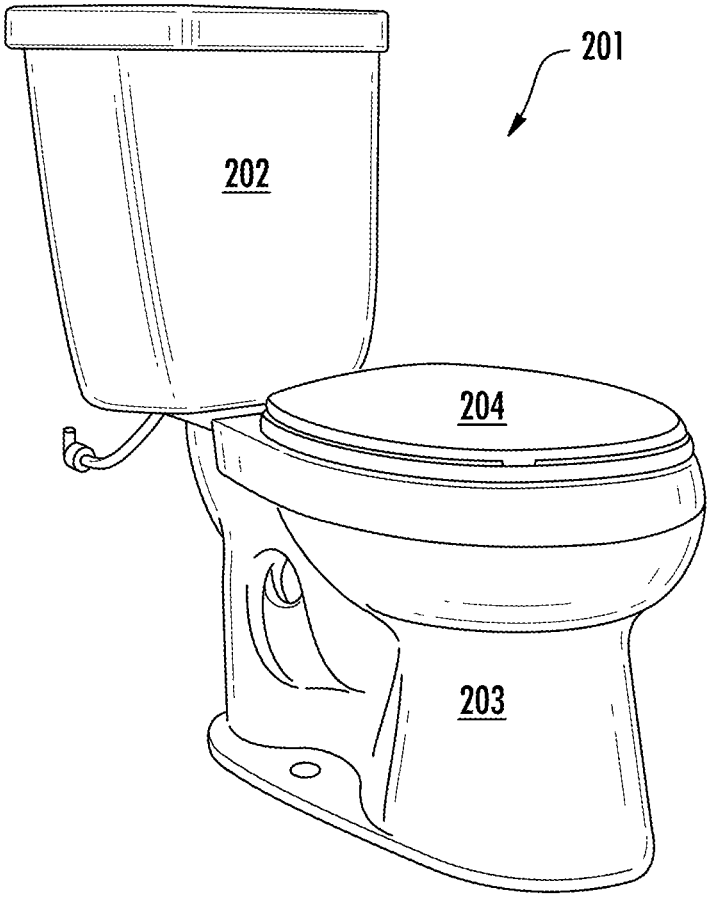
FIG. 14 is a perspective view of another exemplary embodiment of a toilet configured to utilize grey water during operation.
Figure 15:
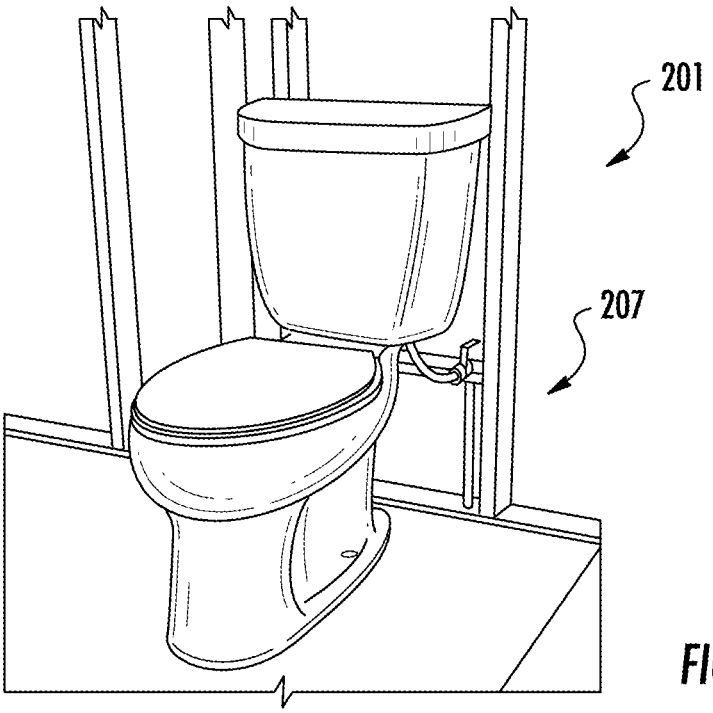
FIG. 15 is another perspective view of the toilet of FIG. 14.

As shown in FIG. 11, the storage device 172 includes an inlet 172*a* and an outlet 172*b*. The inlet 172*a* is configured to receive the grey water from the collection device 170, such as through a conveyor (e.g., a pipe, a plurality of pipes). As shown in FIG. 12, a first pipe 173*a* transfers the grey water from the collection device 170 to a pump 171, and a second pipe 173*b* transfers the grey water from the pump 171 to the storage device 172. The outlet 1726 is configured to introduce the stored grey water to the toilet 101, such as to a passage 106 of the toilet 101. A third pipe 173*c* transfers the grey water from the storage device 172 through the outlet 172*b* to the toilet 101.

FIGS. 14-17 illustrate another exemplary embodiment of a toilet 201 having a grey water system 207 that is configured to introduce captured grey water into the toilet 201 during a flush cycle. The toilet 201 includes a tank 202, a pedestal 203 configured to support the tank 202, a seat assembly 204, and the grey water system 207. The pedestal 203 may be configured similar to, generally the same as, or different than the pedestal 3. For example, the pedestal 203 may include a bowl 231 and a passage 206 fluidly connecting the bowl 231 to a drain pipe or other suitable connection.

Figure 16:
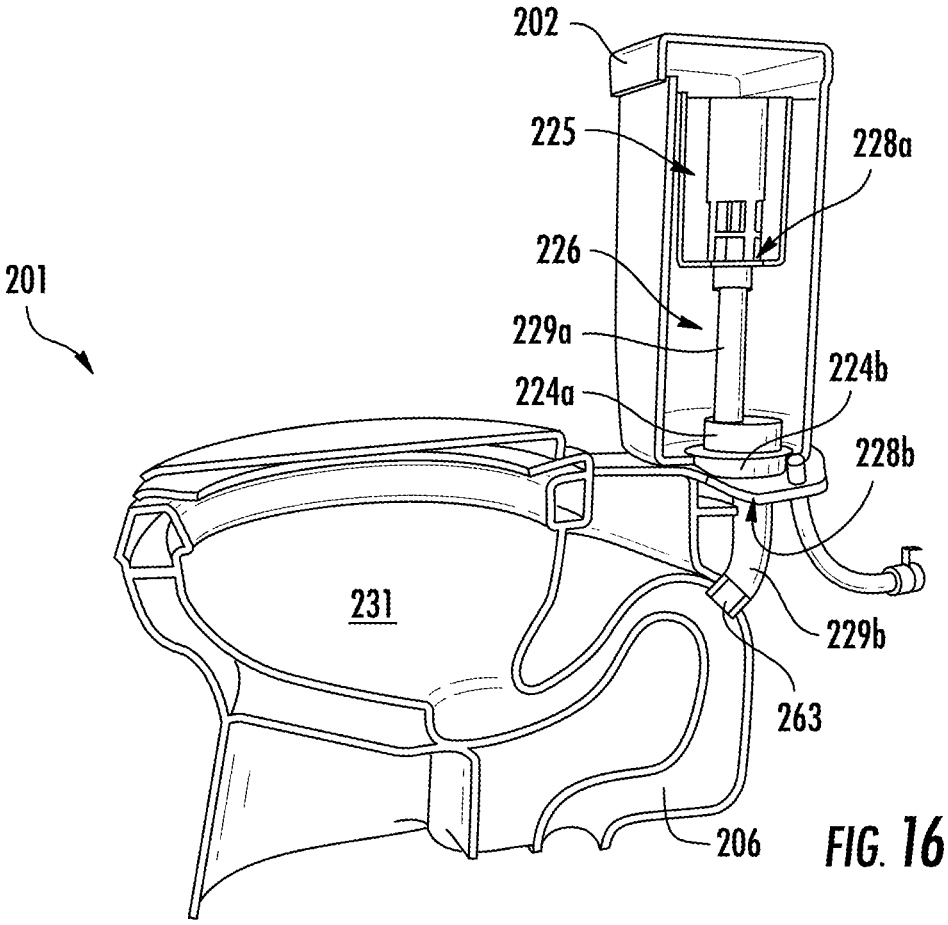
FIG. 16 is a partial sectional perspective view of the toilet of FIG. 14.

As shown in FIG. 16, the tank 202 includes a first compartment 225 (e.g., container, vessel, receptacle, cavity, etc.) and a second compartment 226 that is fluidly separated from the first compartment 225. The first compartment 225 is configured to hold a volume of fresh water, and the second compartment 226 is configured to hold a volume of grey water. In other words, the tank 202 is configured as a dual compartment tank. The tank 202 may be divided so that the first compartment 225 and the second compartment 226 are disposed in a side-by-side configuration, in a top-to-bottom configuration, a front-to-back configuration, or having any suitable configuration. The size (e.g., volume) of the first compartment 225 may be the same as or may be different than the size of the second compartment 226.

Figure 17:
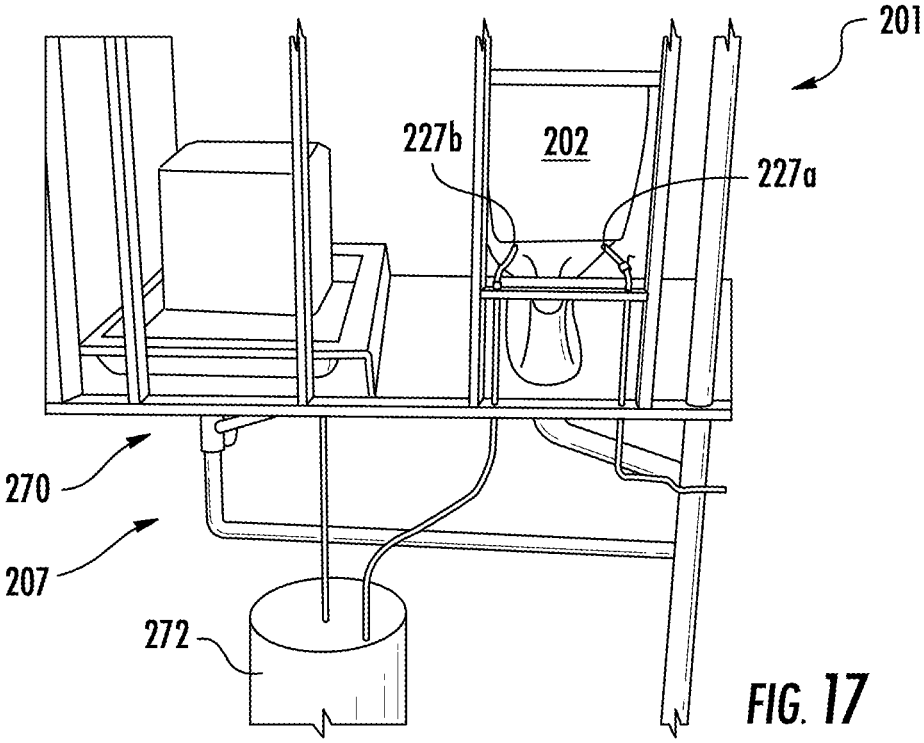
FIG. 17 is another perspective view of the toilet of FIG. 14.

As shown in FIG. 17, the tank 202 may also include a first inlet 227*a* and a second inlet 227*b*. The first inlet 227*a* is fluidly connected to a supply of fresh water to allow fresh water to enter the first compartment 225, such as through a water line. The second inlet 227*b* is fluidly connected to a supply of grey water to allow grey water to enter the second compartment 226, such as from a storage device. The grey water system 207 may include a valve that is configured to control the flow of the fresh water into the first inlet 227*a* and/or of the grey water into the second inlet 227*b*.

The tank 202 may also include a first outlet 228*a* and a second outlet 228*b*. The first outlet 228*a* is provided in the first compartment 225 to allow the fresh water to exit the first compartment 225. The grey water system 207 may include a first valve 224*a* that is configured to regulate or control the flow of the fresh water from the first compartment 225 through the first outlet 228*a*. For example, the first valve 224*a* may be provided in the tank 202. The second outlet 228*b* is provided in the second compartment 226 to allow the grey water to exit the second compartment 226. The grey water system 207 may include a second valve 224*b* that is configured to regulate or control the flow of the grey water from the second compartment 226 through the second outlet 228*b*. For example, the second valve 224*b* may be provided in the tank 202.

The grey water system 207 may optionally include a tube or other suitable device, which may extend between one of the outlets (e.g., first outlet 228*a*, second outlet 228*b*) and its respective inlet in the pedestal. For example, a tube 229*a* may extend between the first outlet 228*a* of the first compartment 225 and an inlet of the toilet 201 (e.g., the pedestal) to supply the fresh water from the tank 202 to the pedestal. Also, for example, a tube 229*b* may extend between the second outlet 228*b* of the second compartment 226 to the pedestal, such as an inlet opening 263 in the passage 206. The first and second valves 224*a*, 224*b* may be provided within the tubes 229*a*, 229*b*, may be provided in the tank 202, or may be coupled to the pedestal.

The toilet 201 may include an actuator, such as a handle or button provided on the tank 202, where the actuator may control the first valve 224*a* and/or the second valve 224*b*. For example, the actuator may be configured to be activated by a user, where upon activation, the actuator may first open the second valve 224*b* to allow a volume of the grey water to enter the toilet 201, such as into the passage 206, then may open the first valve 224*a* after a time delay to allow a volume of the fresh water to enter the bowl 231.

As shown in FIG. 17, the grey water is stored in a storage device in the form of a large scale tank 272. The tank 272 may be provided in the building or dwelling in which the toilet 201 is located (e.g., in an attic, basement, crawl space, etc.), or the tank 272 may be provided external to or remote from the building or dwelling in which the toilet 201 is located. According to another exemplary embodiment, the grey water is provided by a municipality or decentralized water treatment facility (e.g., a city) source, which collects and distributes the grey water. The large scale tank 272 may be configured to supply grey water to multiple toilets configured to utilize grey water during a flush cycle. For example, the large scale tank 272 may supply grey water to a single family home having multiple toilets, a multi-family home (e.g., condominium, apartment, etc) having multiple toilets, a commercial building (e.g., hotel, office building, etc.) having multiple toilets, an industrial building (e.g., a factory, etc.), or any suitable facility or structure having multiple toilets configured to utilize grey water. The large scale tank 272 may also supply multiple facilities or structures with grey water. Thus, the large scale tank 272 may be configured to supply grey water to multiple toilets simultaneously. Each facility may be configured to include a grey water collection system to capture grey water.

Figure 18:
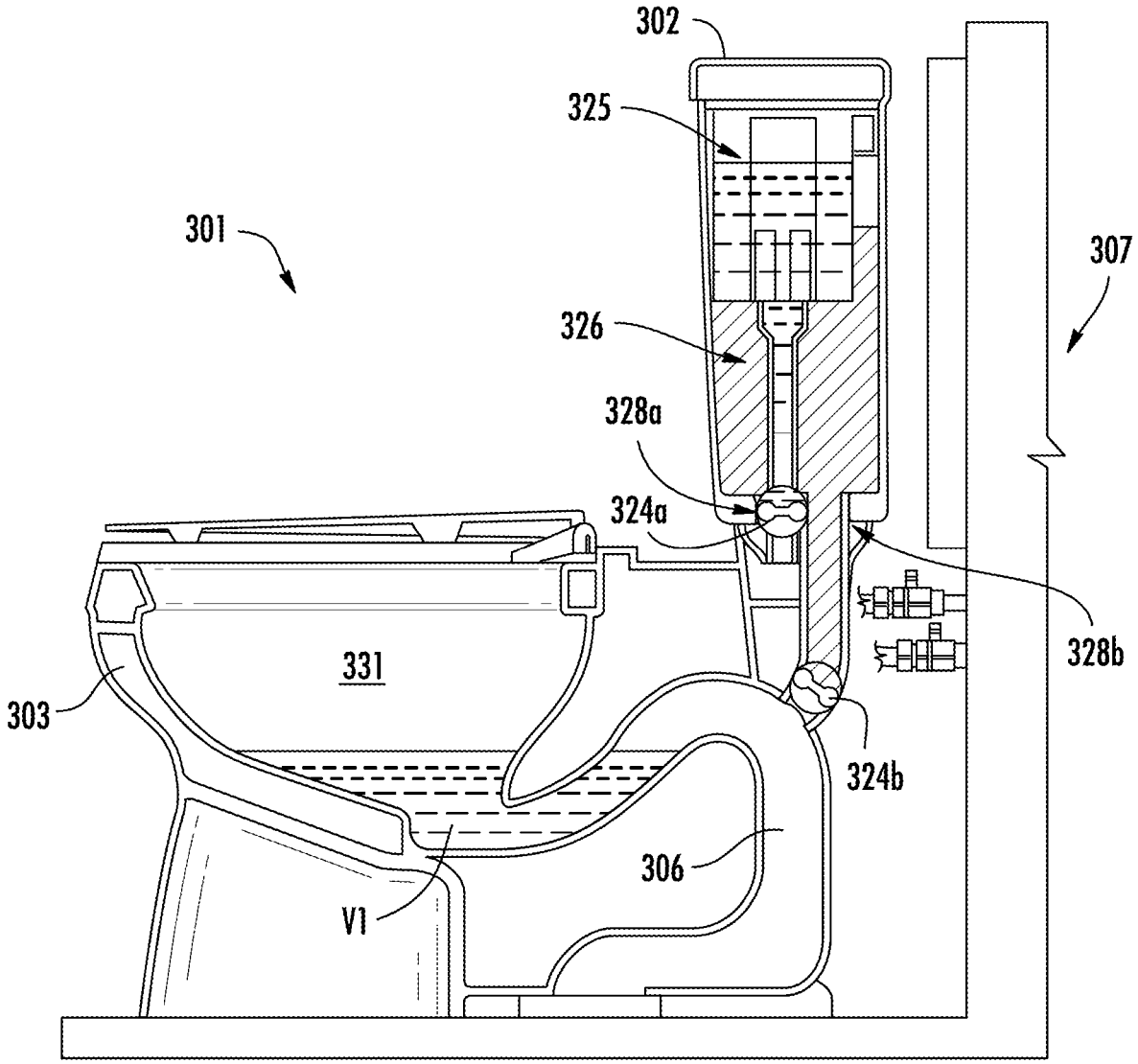
FIG. 18 is a side-sectional view of an exemplary embodiment of a toilet configured to utilize grey water and showing a first phase of operation.
Figure 19:
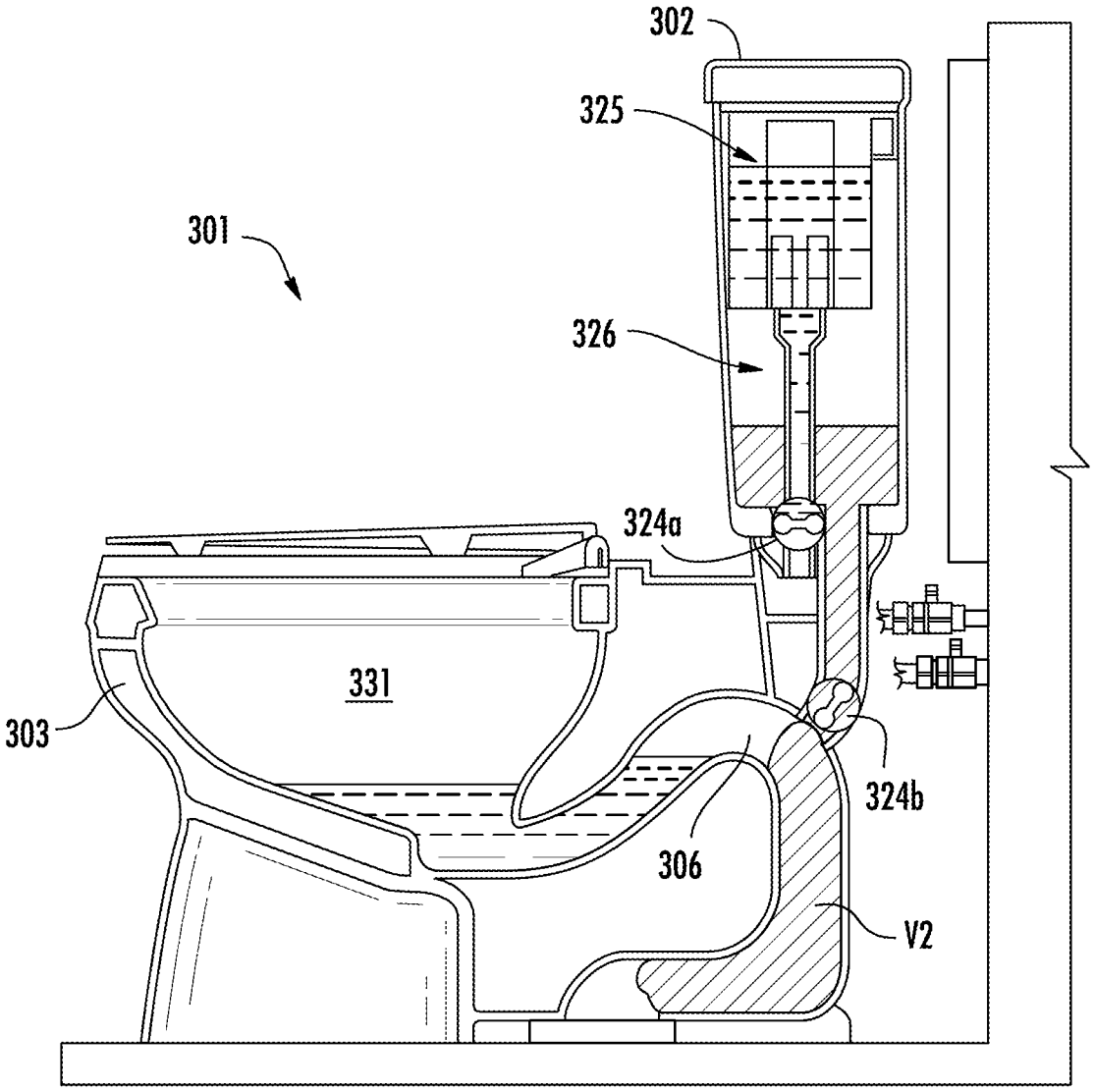
FIG. 19 is a side-sectional view of the toilet of FIG. 18 showing a second phase of operation.
Figure 20:
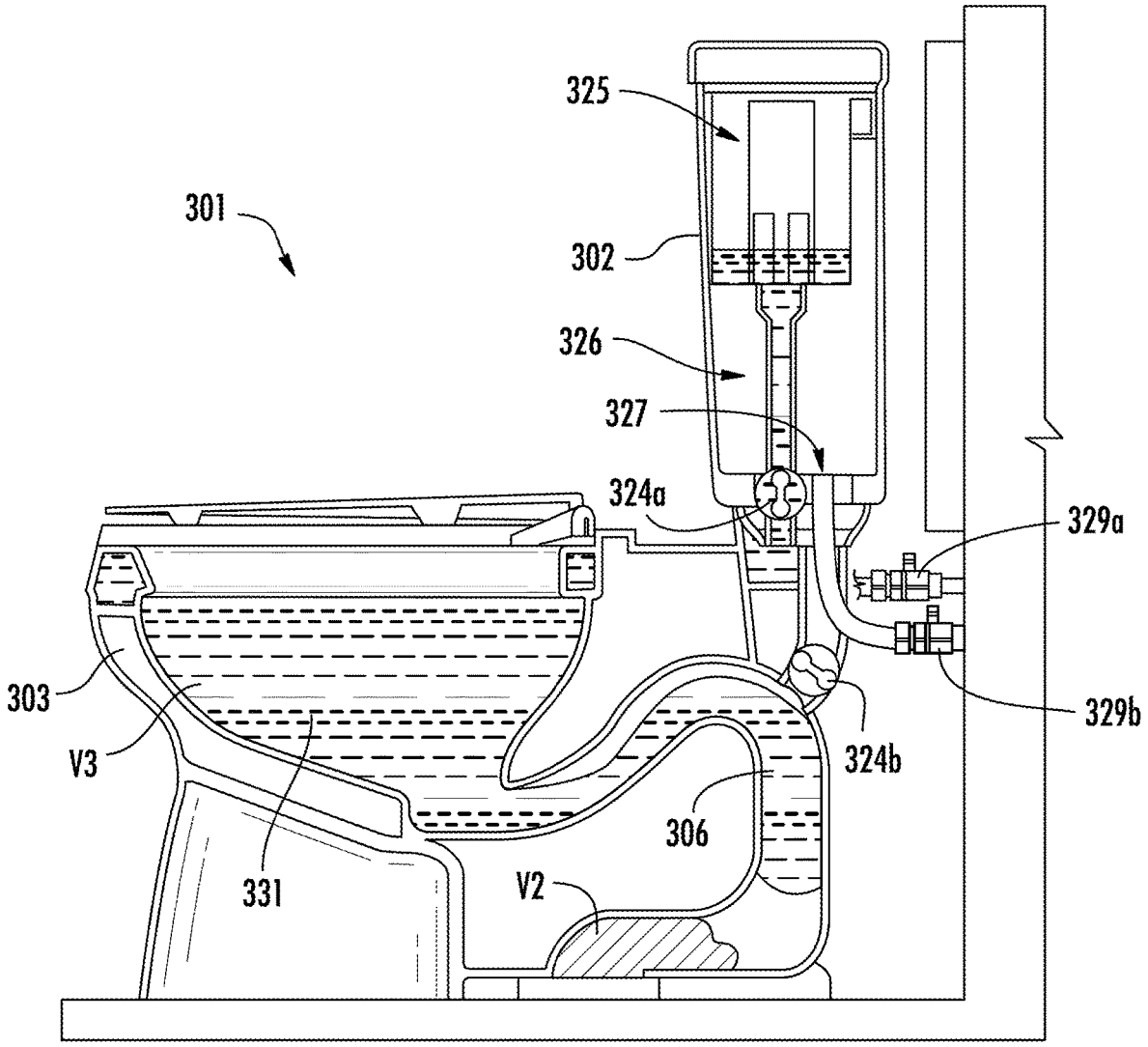
FIG. 20 is a side-sectional view of the toilet of FIG. 18 showing a third phase of operation.

FIGS. 18-20 illustrate another exemplary embodiment of a grey water toilet assembly including a toilet 301 and a grey water system 307 that is configured to introduce captured grey water into the toilet 301 during a flush cycle. The toilet 301 includes a tank 302, a pedestal 303 configured to support the tank 302, and the grey water system 307. The pedestal 303 may be configured similar to, generally the same as, or different than the pedestals disclosed herein. For example, the pedestal 303 may include a bowl 331 and a passage 306 fluidly connecting the bowl 331 to a drain pipe or other suitable connection.

As shown, the tank 302 is configured as a dual compartment tank, having a first compartment 325 configured to hold a volume of fresh water and a second compartment 326 configured to hold a volume of grey water. The first and second compartments 325, 326 are fluidly separated to prohibit commingling of the fresh and grey waters.

The tank 302 may include an inlet, such as to allow a fluid (e.g., fresh water, grey water) to be introduced into the tank 302, and an outlet, such as to allow the fluid to exit the tank 302. According to an exemplary embodiment, the tank 302 includes a first inlet (not shown), a second inlet 327, a first outlet 328*a*, and a second outlet 328*b*. The first inlet (not shown) is configured to allow the fresh water to enter the first compartment 325. As shown in FIG. 20, the second inlet 327 is configured to allow the grey water to enter the second compartment 326, such as from a storage device of the grey water system 307. The first outlet 328*a* is configured to allow the fresh water to exit the first compartment 325. The second outlet 328*b* is configured to allow the grey water to exit the second compartment 326.

The grey water system 307 may include a valve configured to control the flow of fluid through an inlet or outlet of the tank 302. As shown in FIG. 20, the system includes a first inlet valve 329*a* and a second inlet valve 329*b*. The first inlet valve 329*a* is fluidly connected to the first inlet of the first compartment 325 to control the flow of the fresh water into the first compartment 325. The second inlet valve 329*b* is fluidly connected to the second inlet 327 of the second compartment 326 to control the flow the grey water into the second compartment 326.

As shown in FIGS. 18-20, the grey water system 307 also includes a first outlet valve 324*a* and a second outlet valve 324*b*. The first outlet valve 324*a* is configured to control the flow of the fresh water from the first compartment 325 to the bowl 331, such as through a rim channel or jet of the toilet 301. The second outlet valve 324*b* is configured to control the flow of the grey water from the second compartment 326 to the passage 306.

The grey water system 307 may optionally include one or more than one tube, pipe, or other suitable device to transfer the water (e.g., fresh water, grey water) to and/or from the tank 302. For example, the system may include a pair of inlet tubes, where one inlet tube transfers fresh water to the first compartment 325, and where the other tube transfers grey water to the second compartment 326. Also, for example, the system may include a pair of outlet tubes, where one tube transfers fresh water from the first compartment 325 to the bowl 331 of the toilet 301, and where the other tube transfers grey water from the second compartment 326 to the passage 306 of the toilet 301.

The grey water toilet system of FIGS. 18-20 may include a method of flushing the toilet 301 that is similar to or the same as the other methods disclosed herein, such as the five step methods. Alternatively, the method of the flushing the toilet 301 may be different. FIG. 18 illustrates a pre-flush condition of the toilet 301, where the bowl 331 includes a volume V1 of fresh water therein, and both outlet valves 324*a*, 324*b* are in the closes position. Further, the first compartment 325 of the tank 302 contains fresh water and the second compartment 326 of the tank 302 contains grey water. Upon actuation of a flush cycle, the second outlet valve 324*b* opens and grey water is introduced into the passage 306, as shown in FIG. 19. A volume V2 of grey water is delivered to the passage 306. At a time before or after the opening of the second outlet valve 324*b*, the first outlet valve 324*a* is opened to allow a fresh water to be introduced into the bowl 331. An amount of fresh water is introduced into the bowl 331 until a volume V3 is reached. The supply of fresh water and grey water induces a flush cycle of the contents of the bowl 331 through the passage 306. The second outlet valve 324*b* may be closed prior to the discharge of the contents of the bowl 331 through the passage 306. At a time before or after the closing of the second outlet valve 324*b*, the first outlet valve 324*a*.

The tank 302 may be configured as a pressure vessel that may assist in the flush cycle of the toilet 301. For example, the first compartment 325 may be in the form a well (e.g., depression) in the tank 302, where the fresh water may operate under the influence of gravity to assist in the flush cycle. The second compartment 326 may be under pressure, which may be induced by the pressure of being pumped from, for example, a municipality, which could be used to regulate the flush cycle and timing, such as regulate the fresh water flush and timing. Thus, the tank 302 may be configured as a dual gravity and pressure operated tank. Alternatively, the tank 302 may rely on only gravity or only pressure to operate the tank.

FIGS. 21-25 illustrate another exemplary embodiment of a toilet 401 having a grey water system 407 that is configured to introduce captured grey water into the toilet 401 during a flush cycle. The toilet 401 includes a pedestal 403, a fresh water assembly 402, a grey water system 407, and a housing 408 that is configured to close off and conceal the pedestal 403, the fresh water assembly 402, and the grey water system 407 to provide a generally hexahedron shaped toilet 401 with improved aesthetics.

The pedestal 403 may be configured similar to, generally the same as, or different than the pedestal 3. For example, the pedestal 403 may include a bowl 431 and a passage 406 fluidly connecting the bowl 431 to a drain pipe or other suitable connection. Additionally, the pedestal 403 includes an inlet opening provided in the bowl 431, where the inlet opening is configured to allow fresh water to be introduced into the bowl 431. For example, the toilet 401 may have a jet for introducing a pressurized flow of fresh water into the bowl 431 through the inlet opening.

Figure 23:
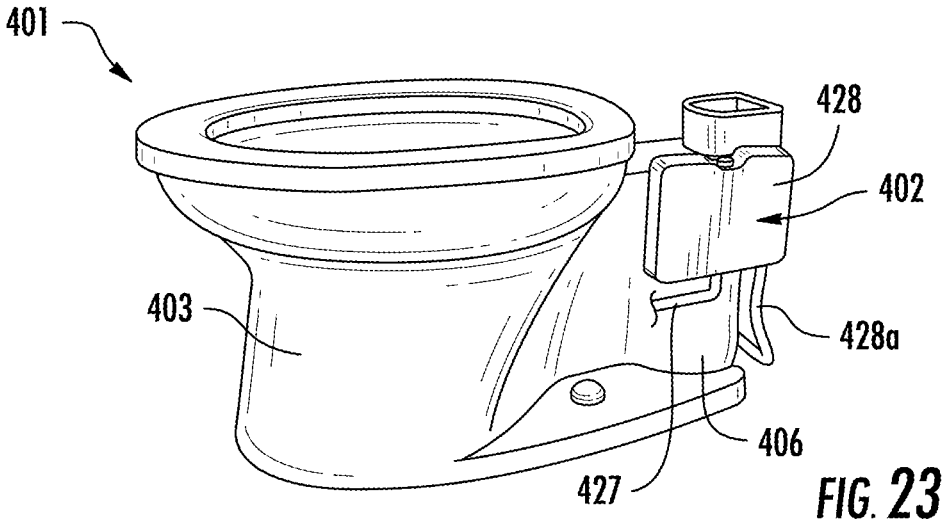
FIGS. 23-25 are perspective views of the toilet of FIG. 21 with the housing removed for clarity.

As shown in FIG. 23, the fresh water assembly 402 includes a storage tank 428, where the storage tank 428 holds the fresh water until a flush cycle is activated. Once a flush cycle is activated, fresh water is delivered to the bowl 431 through an outlet 427. For example, during a flush cycle, the jet may discharge the pressurized flow of the fresh water from the storage tank 428 into the bowl 431 through the inlet opening. The storage tank 428 includes an inlet 428*a* to receive the supply of fresh water therethrough. The fresh water assembly 402 may also include a valve for controlling the flow of the fresh water from the storage tank 428 to the bowl 431 and/or from a fresh water supply to the storage tank 428.

Figure 24:
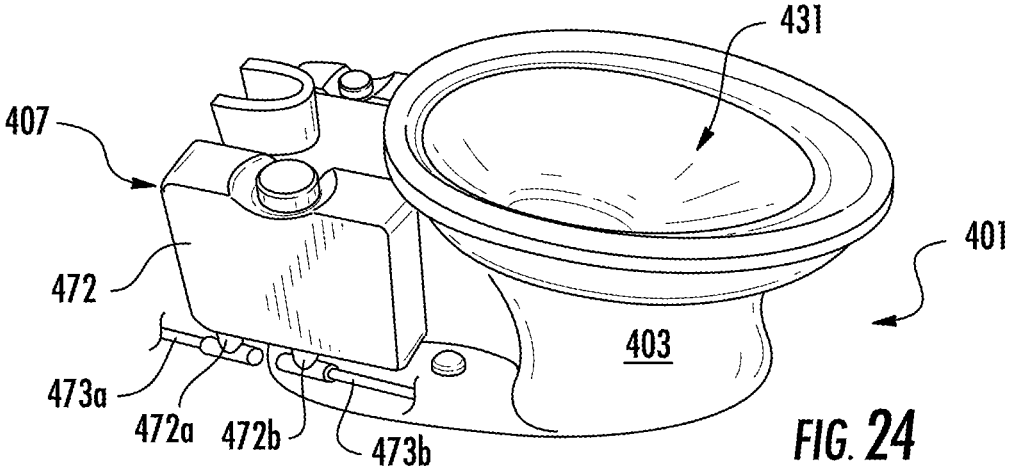
Figure 25:
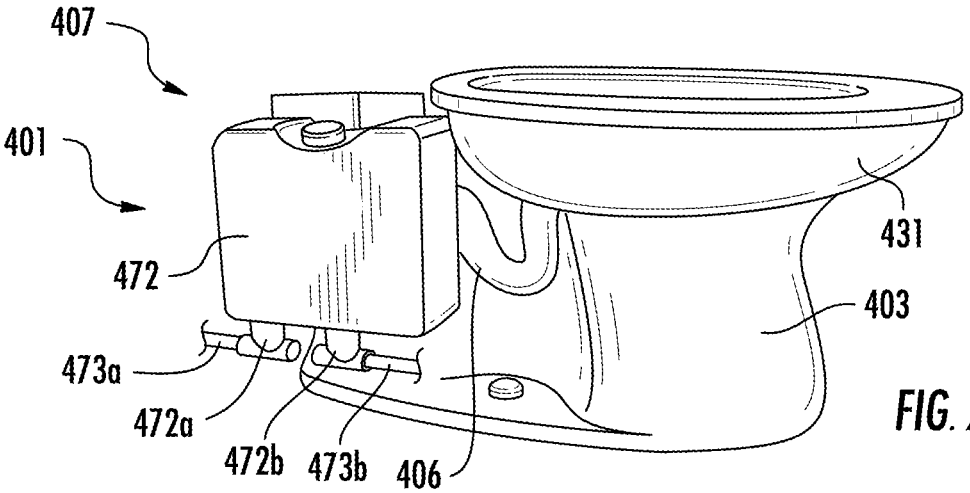

As shown in FIGS. 24 and 25, the grey water system 407 includes a second storage tank 472 having an inlet 472*a* and an outlet 472*b*. The inlet 472*a* receives the grey water from a source, such as, for example, a collection device or a municipal supply. The grey water is discharged from the second storage tank 472 through the outlet 472*b* to be delivered to the toilet 401, such as to the passage 406. As shown, the grey water system 407 may include piping or any other suitable device to transfer the grey water to and/or from the second storage tank 472. For example, a first pipe 473*a* may deliver the grey water to the tank 472 through the inlet 472*a* from the source, and a second pipe 473*b* may deliver the grey water to the passage 406 from the second storage tank 472.

The grey water system 407 may also include a valve that is configured to control the flow of the grey water to and/or from the second storage tank 472. For example, the tank 472 may include a valve provided therein, where the valve controls the flow of the grey water from the tank 472 to the passage 406. The valve may be controlled by an actuator that triggers a flush cycle of the toilet 401, or any other suitable device.

Figure 21:
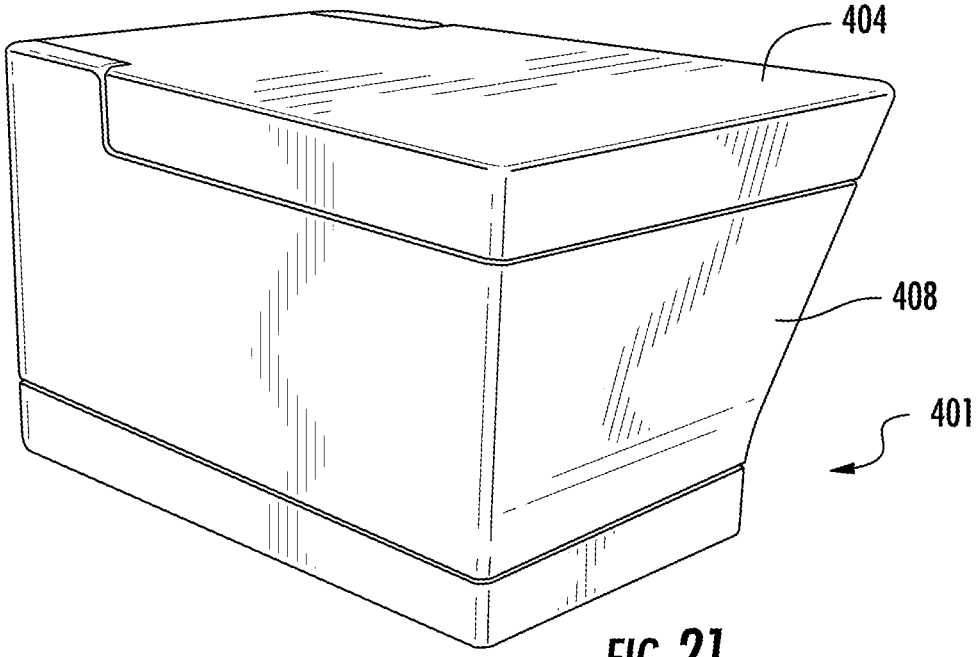
FIG. 21 is a perspective view of yet another exemplary embodiment of a toilet configured to utilize grey water during operation, which is shown with a cover in the closed position.
Figure 22:
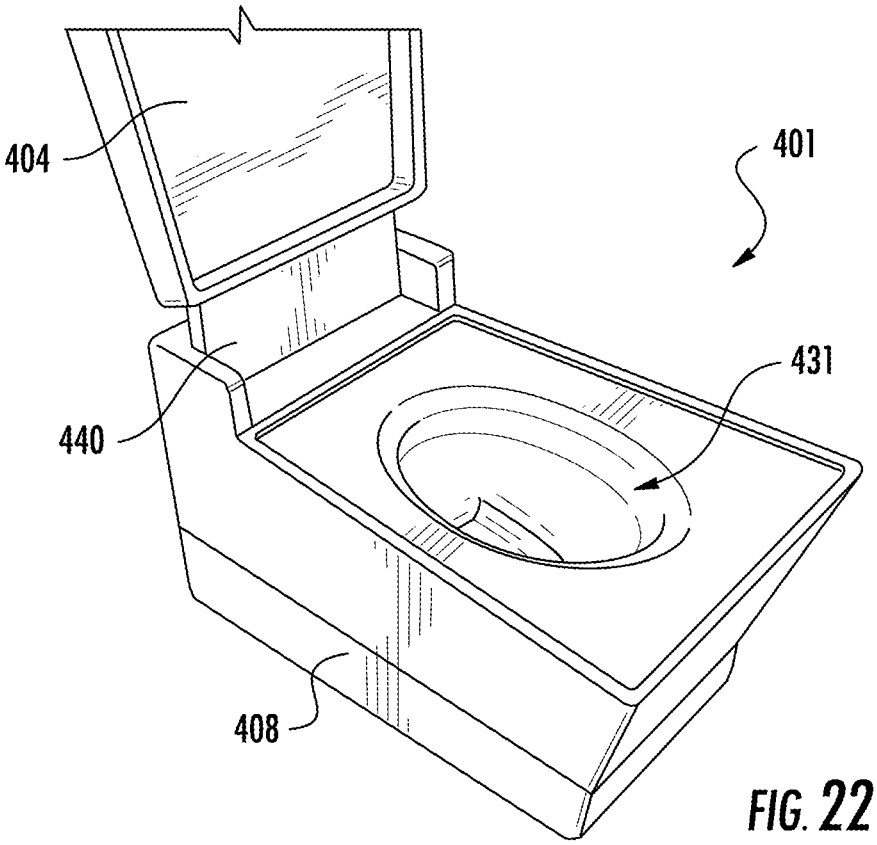
FIG. 22 is a perspective view of the toilet of FIG. 21 with the cover shown in an open position.

As shown in FIGS. 21 and 22, the toilet 401 may also include a lid 404 in the form of a covering member that is configured to pivot about a hinge 440 attached to the housing 408. The lid 404 may pivot between a closed (e.g., down) position and an open (e.g., up) position, such that when in the closed position the lid 404 covers up the opening to the bowl 431 of the pedestal 403, and when in the open position the lid 404 exposes (i.e., allows access to) the opening to the bowl 431.

The toilets as disclosed herein are configured to include grey water systems that introduce a volume of grey water into the toilet, such as into the passage or trapway, to reduce the consumption of fresh water per flush cycle of the toilet. The grey water systems may also include collection devices that capture the grey water and transfer the grey water to a holding tank until utilized during a flush cycle of the toilet. The grey water may be introduced into the toilet through the passage, such as a rearward and upper portion of the passage (i.e., on the waste side of the system) to prohibit the grey water from back-flowing into the bottom of the bowl of the toilet. This arrangement may advantageously meet regulations (e.g., government regulations) without requiring any additional service, such as filters, tablets (e.g., chlorine), etc., by the end user. This arrangement may also be transparent to the end user, as the toilet may have the appearance of functioning as a conventional toilet that uses only fresh water, and would not require any additional maintenance relative to conventional toilets, since the grey water is introduced on the waste side of the system. The toilets using grey water as disclosed herein may be installed into existing structures with only a minimal amount of remodeling, as the systems are minimally invasive to existing infrastructure. Further, conventional toilets may be retrofitted to include a grey water system. These and other advantages of the toilets having grey water systems are apparent in view of the disclosed embodiments herein.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended. to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilets and grey water systems as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, one element disclosed in one embodiment may be used in any other embodiment disclosed herein.

We claim:

1. A grey water trapway system for a toilet, the grey water trapway system comprising:

a trapway passage first end with a connection to a toilet bowl;

a trapway passage curved portion at a height higher than the connection to the toilet bowl;

a trapway passage down-leg extending from the trapway passage curved portion in a substantially vertical direction;

an inlet opening configured to supply grey water to the trapway passage down-leg;

a trapway passage horizontal portion extending from the trapway passage down-leg to an exit to a drain pipe; and a dispensing pipe directly connected to the drain pipe and configured to connect the drain pipe and grey water trapway system to a storage tank.

2. The grey water trapway system of claim 1, wherein the trapway passage horizontal portion extends under the trapway passage curved portion.

3. The grey water trapway system of claim 1, further comprising:

a trapway passage up-leg connected to the trapway passage first end and shaped and configured to cause a portion of water to remain in the toilet bowl following a flush cycle.

4. The grey water trapway system of claim 1, wherein the grey water primes a siphon for the toilet bowl.

5. A grey water trapway system for a toilet, the grey water trapway system comprising:

a trapway passage curved portion;

a trapway passage down-leg extending from the trapway passage curved portion in a substantially vertical direction;

an inlet opening configured to supply grey water to the trapway passage down-leg;

a trapway passage horizontal portion extending from the trapway passage down-leg to an exit to a drain pipe, and a dispensing pipe directly connected to the drain pipe and configured to connect the drain pipe and grey water trapway system to a storage tank.

6. The grey water trapway system of claim 5, further comprising:

a trapway passage first end with a connection to a toilet bowl.

7. The grey water trapway system of claim 6, further comprising:

a trapway passage up-leg connected to the trapway passage first end and shaped to define a portion of water to remain in a toilet bowl following a flush cycle.

8. The grey water trapway system of claim 5, wherein the trapway passage horizontal portion extends under the trapway passage curved portion.

9. The grey water trapway system of claim 5, further comprising:

a valve configured to open and close the inlet opening.

10. The grey water trapway system of claim 5, wherein the grey water primes a siphon for the toilet bowl.

11. A grey water system configured to be in fluid communication with a trapway of a toilet, the grey water system comprising:

a collection device configured to capture water from at least one appliance;

a pump configured to cause the captured water to move from the at least one appliance to a storage tank, wherein the storage tank is connected to the trapway of the toilet;

a pipe configured to couple to an outlet of the storage tank and couple to a trapway of the toilet, wherein the trapway comprises:

a trapway passage curved portion;

a trapway passage down-leg extending from the trapway passage curved portion in a substantially vertical direction; and a trapway passage horizontal portion extending from the trapway passage down-leg to an exit to a drain pipe; and a dispensing subsystem directly connected to the drain pipe and configured to connect the drain pipe and the grey water system to direct excess grey water from the storage tank.

12. The grey water system of claim 11, further comprising:

a valve in-line with the pipe and positioned between the outlet of the storage tank and the trapway of the toilet.

13. The grey water system of claim 11, further comprising:

a trapway passage first end with a connection to a toilet bowl.

14. The grey water system of claim 13, further comprising:

a trapway passage up-leg connected to the trapway passage first end and shaped to define a portion of water to remain in a toilet bowl following a flush cycle.

15. The grey water system of claim 11, wherein the trapway passage horizontal portion extends under the trapway passage curved portion.

16. The grey water system of claim 11, further comprising:

an inlet opening configured to supply grey water to the trapway passage down-leg.

17. The grey water system of claim 11, wherein the grey water primes a siphon for the toilet.

18. The grey water system of claim 11, wherein an inlet opening for the trapway of the toilet is angled such that gravitation force at least partially causes the grey water to be introduced into the trapway.

19. The grey water system of claim 11, wherein the at least one appliance includes a bath or a shower.

* * * * *